United States Patent [19]

Thomson et al.

[11] 3,983,802

[45] Oct. 5, 1976

[54] IMPRINTER HAVING VARIABLE AMOUNT ASSEMBLY AND IMPROVED PORTABLE TRANSACTION-LOG RECORDER USABLE THEREWITH

[75] Inventors: Morton W. Thomson; Cecil G. Olson, both of Castro Valley; Mitchel A. Trout, Albany, all of Calif.

[73] Assignee: Dymo Industries, Inc., San Francisco, Calif.

[22] Filed: Feb. 6, 1975

[21] Appl. No.: 547,756

Related U.S. Application Data

[63] Continuation-in-part of Ser. No. 497,485, Aug. 14, 1974, abandoned.

[52] U.S. Cl. ..... 101/45; 101/269

[51] Int. Cl.[2] ..... B41F 3/04

[58] Field of Search ..... 101/45, 56, 269–274, 101/70

[56] References Cited

UNITED STATES PATENTS

| | | | |
|---|---|---|---|
| 3,138,091 | 6/1964 | Maul | 101/45 |
| 3,280,739 | 10/1966 | Hu | 101/45 X |
| 3,334,582 | 8/1967 | Mahoney | 101/45 |
| 3,351,005 | 11/1967 | Giori | 101/70 X |
| 3,358,596 | 12/1967 | Davis | 101/269 |
| 3,363,547 | 1/1968 | Thut et al. | 101/45 |
| 3,420,171 | 1/1969 | Maul et al. | 101/269 |
| 3,508,488 | 4/1970 | Maul et al. | 101/45 |
| 3,606,833 | 9/1971 | Deutsch | 101/45 |
| 3,608,485 | 9/1971 | Schulze | 101/269 |
| 3,709,144 | 1/1973 | Sims | 101/269 X |
| 3,824,922 | 7/1974 | VonAcker | 101/45 |
| 3,826,190 | 7/1974 | Zofchak | 101/45 |
| 3,859,509 | 1/1975 | Dillingham et al. | 101/269 X |
| 3,865,026 | 2/1975 | Trout | 101/45 |

*Primary Examiner*—Edgar S. Burr
*Assistant Examiner*—Edward M. Coven
*Attorney, Agent, or Firm*—Gerald J. Ferguson, Jr.; Joseph J. Baker

[57] ABSTRACT

A variable amount imprinter and a portable transaction-log recorder usable therewith, the imprinter having a pivotally mounted head assembly, upon which is mounted a roller platen assembly for effecting imprinting. Two interlocks are provided to prevent closing of the head assembly until (a) a tray for a printing plate such as a credit card has been latched in place in the recorder and (b) at least one preselected item of the variable amount data has been set to a non-zero value. Releasable latching means lock the head in its closed position until the imprinting stroke of the roller platen assembly has been completed, at which time the head is automatically returned to its open position.

Means responsive to movement of the roller platen assembly during the imprinting stroke reset the variable amount data to zero after it has been imprinted. Means are also provided for centralizing the digit wheels of the variable amount assembly prior to the imprinting thereof. When the roller platen assembly reaches the end of its imprinting stroke, it is automatically returned to its start position. At this time, as stated above, the head assembly is also automatically opened and in response thereto, a counter in the portable transaction recorder indicating the number of the next transaction to be processed is incremented by one and, in response thereto, the latch on the credit card tray is unlatched.

13 Claims, 19 Drawing Figures

FIG. 5
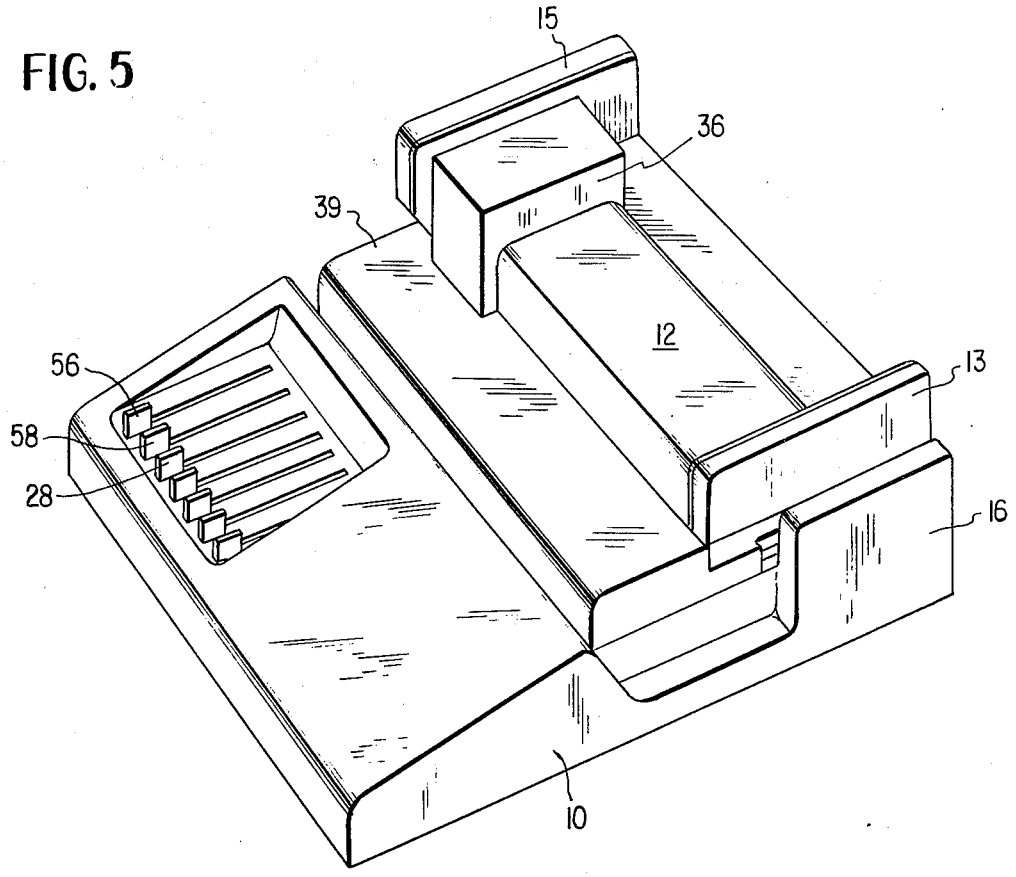
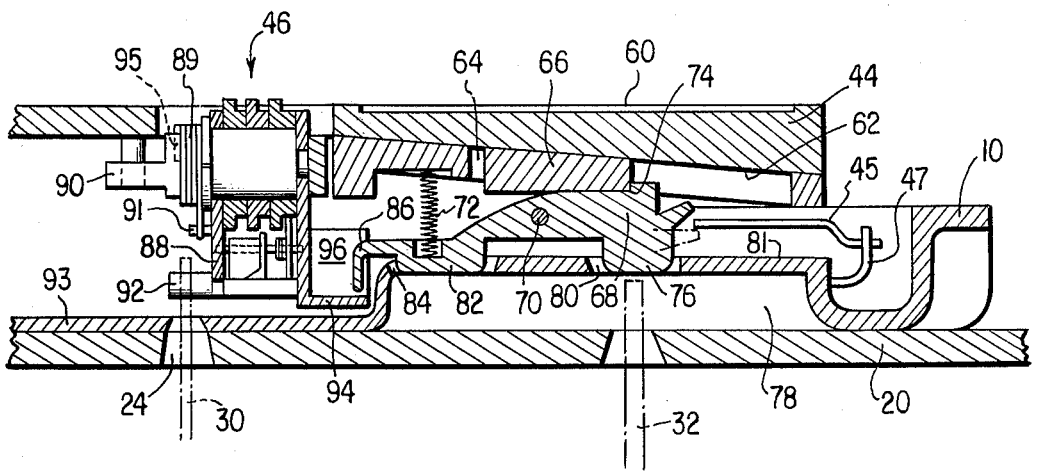
FIG. 6

107
15
18
296
344
14
284
294
318
258
312
310
314
14.
348
347
352
290
292
288
18.
109
326
345
346
350
282
304
322
246
244
228
324
286
142
284
196
354
285
250
320
140
10.
148
144
194
192
316
380
15.
276
256
252
190
280
242
248
226

104
110
378
128
30
24
364
19.
366
372
152
368
374
363
360
362
369
367
365
382
130
370
376
118
126
32
26
8.
112
122
114
124
132
134
384
168
169
12.
106
13
18
108
172
164
176
16
166

IMPRINTER HAVING VARIABLE AMOUNT ASSEMBLY AND IMPROVED PORTABLE TRANSACTION-LOG RECORDER USABLE THEREWITH

CROSS REFERENCE TO RELATED APPLICATIONS

This application is a continuation-in-part of U.S. patent application Ser. No. 497,485 filed Aug. 14, 1974, now abandoned.

The invention described herein is also related to that described and claimed in U.S. patent application Ser. No. 434,209, filed Jan. 17, 1974, by Morton W. Thomson and Mitchel A. Trout on "Portable Transaction-Log Recorder" and assigned to the assignee of the present invention. The above patent application is hereby incorporated herein by reference.

BACKGROUND OF THE INVENTION

1. Field of the Invention

This invention relates to imprinters and portable transaction-log recorders and, in particular, to imprinters usable with portable transaction-log recorders, to imprinters having variable amount assemblies and to recorders for use with such imprinters.

2. Discussion of the Prior Art

Various imprinting systems are known wherein data from a plurality of different transactions are imprinted on a single transaction-log, see, for example, U.S. Pat. Nos. 2,647,459 issued Aug. 4, 1953 and 3,762,316 issued Oct. 2, 1973. In particular, in U.S. Pat. No. 3,762,316, there is disclosed an imprinter for minimizing the bulk of invoices sent to a central accounting office by a number of dealer outlets. As brought out in detail in the above patent, this is effected by substituting a single transaction-log for a large number of invoices where each invoice corresponds to a separate transaction. Thus, on the transaction-log is recorded the data corresponding to a large number of transactions. Hence, a single document (the transaction-log) can now be sent to the central accounting office in place of a large number of individual invoices, the latter being difficult to process and expensive to mail.

The portable transaction-log recorder of aforementioned U.S. application Ser. No. 434,209 permits the imprinting system of U.S. Pat. No. 3,762,316 to be more readily used in certain retail outlets such as gasoline stations. Thus, the customer's credit card is inserted in a latchable, slideable tray positioned in the side of the recorder and slid beneath the transaction-log, which is also disposed within the recorder. The tray is automatically latched in place. An invoice is then positioned on the recorder. The recorder is then taken to a central imprinter annd positioned therein. The data of the transaction is imprinted on the invoice and transaction-log. The recorder is the returned to the customer where he signs the invoice positioned thereon. His copy of the invoice is given to him and the recorder is returned to storage for the next transaction. After the transaction-log is filled with data, it is removed from the recorder and sent to the central accounting office.

SUMMARY OF THE INVENTION

A primary object of this invention is the provision of an improved imprinter for use with a portable transaction-log recorder.

A further object of this invention is the provision of an imprinter of the above type having an interlock for preventing operation of the imprinter until a predetermined condition has been satisfied in the recorder.

A further object of this invention is the provision of an imprinter of the above type where the recorder includes a counter for indicating the number of the transaction being processed and the imprinter includes means for incrementing the counter by one each time an imprinting operation occurs.

A further object of this invention is the provision of an imprinter of the above type where said recorder includes a movable tray for holding a printing plate such as credit card and means for latching the tray in place and the imprinter includes means for releasing the latch after each imprinting operation.

A further object of this invention is the provision of an improved recorder of the above type where the tray is automatically unlatched in response to the incrementing of the counter by the imprinter.

A further object of this invention is the provision of an imprinter having a variable amount assembly where the variable amount data is automatically reset to zero after it has been imprinted.

A further object of this invention is the provision of an imprinter of the above type having an interlock for preventing operation of the imprinter until at least one preselected item of variable data is set to a non-zero value.

A further object of this invention is the provision of an imprinter of the above type having improved means for automatically centralizing the variable amount data.

A further object of the invention is the provision of an imprinter of the above type where the roller platen assembly is automatically returned to its start position at the end of the imprinting stroke.

A further object of this invention is the provision of an imprinter of the above type having a pivotally mounted head assembly upon which the roller platen assembly is mounted, improved means being provided to automatically raise the head assembly to its open position at the end of the imprinting stroke.

These and other objects of the invention will become apparent from a reading of the specification and claims taken together with the drawing.

BRIEF DESCRIPTION OF THE DRAWING

FIG. 5 is a perspective view of the imprinter with recorder of FIG. 4, the head assembly being closed.

FIG. 6 is a cross sectional view taken on line 6—6 of FIG. 2.

DETAILED DESCRIPTION OF THE PREFERRED EMBODIMENT

1. Overall Construction and Operation.

Figure 1:
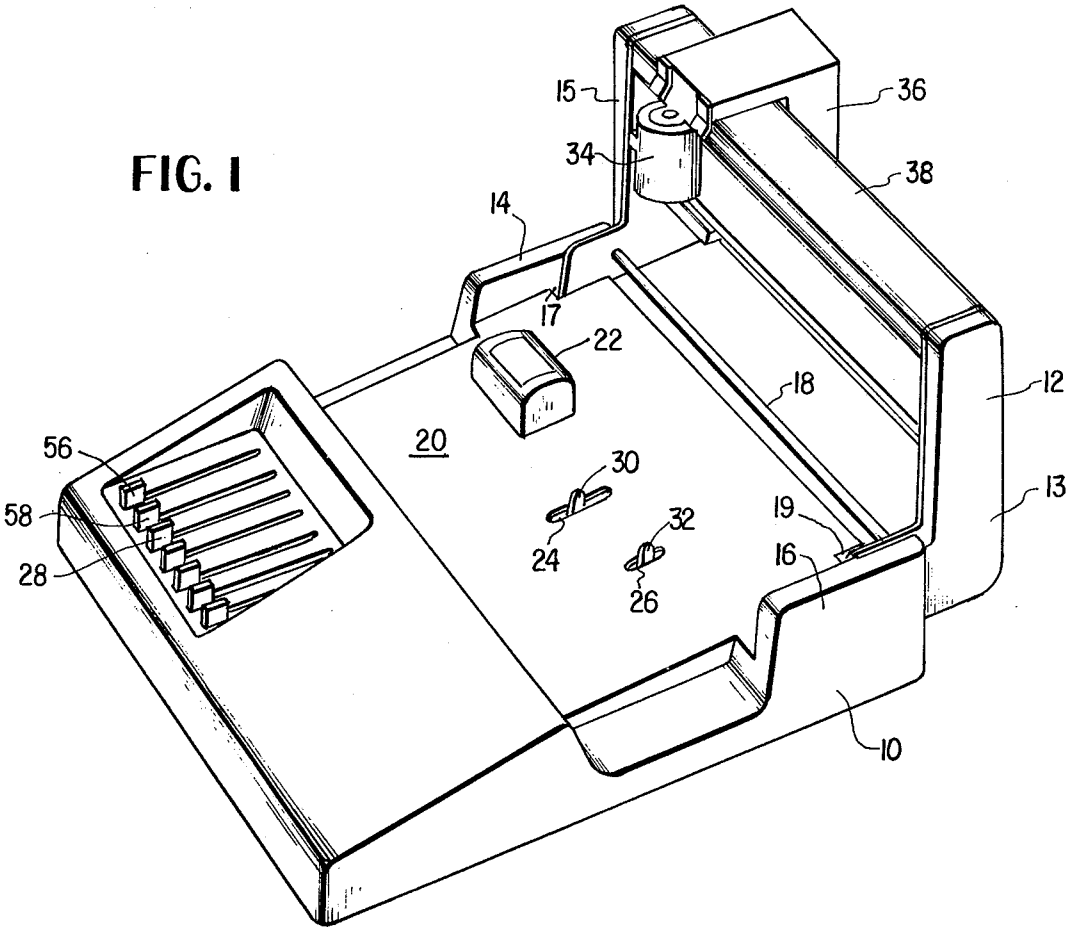
FIG. 1 is a perspective view of an illustrative imprinter in accordance with the invention with the head assembly open.

Referring to FIG. 1, there is shown an illustrative imprinter in accordance with the invention comprising a base 10 and a head assembly or head 12 pivotally mounted thereon. The base includes side plates 14 and 16 between which extends a head shaft 18, the head 12 being pivotally mounted on shaft 18. The base 10 also includes a bed 20 for receiving a portable transaction-log recorder of the type described in aforementioned U.S. application Ser. No. 434,209. Openings 17 and 19 are provided in bed 20 to enable arms 13 and 15 of head 12 to pivot as the head is opened and closed. Disposed within bed 20 is a variable amount assembly 22. The variable amount assembly is operated from keyboard 28. Also provided are slots 24 and 26 through which extend arms 30 and 32, which coact with internal portions of the recorder in a manner to be described hereinafter. Conventionally disposed within head 12 is a roller platen assembly comprising roller platen 34, carriage 36 and rail assembly 38.

Figure 2:
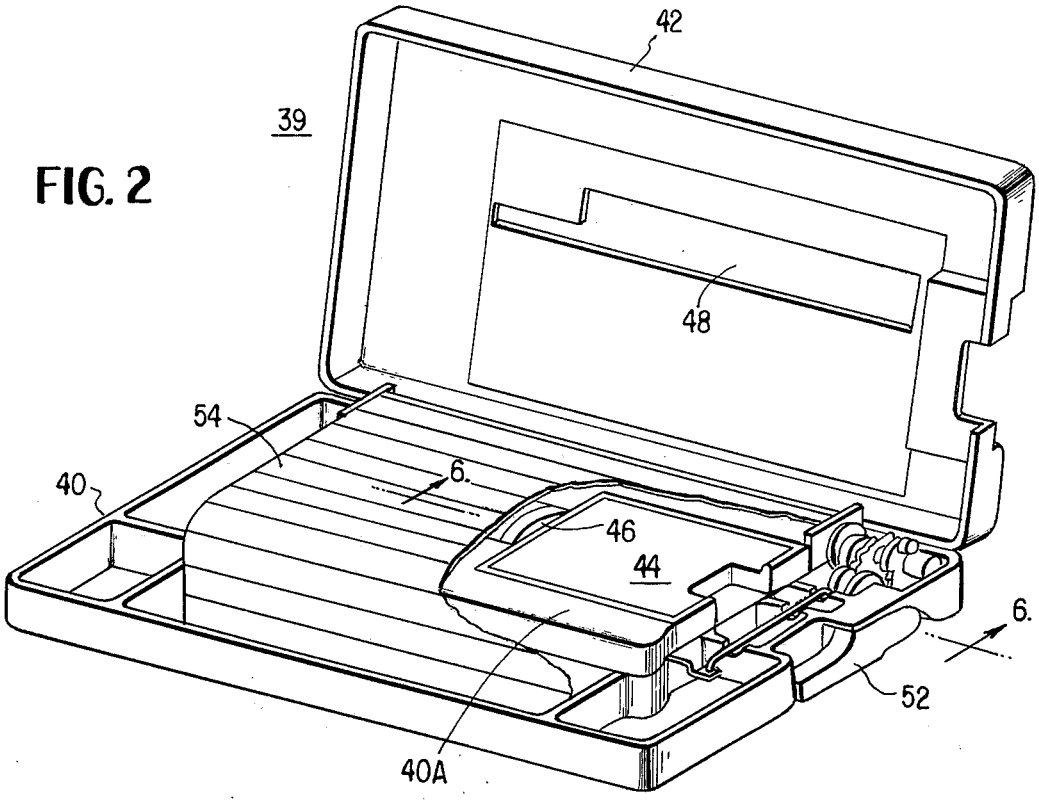
FIG. 2 is a perspective view of an illustrative transaction-log recorder in accordance with the invention when opened.
Figure 3:
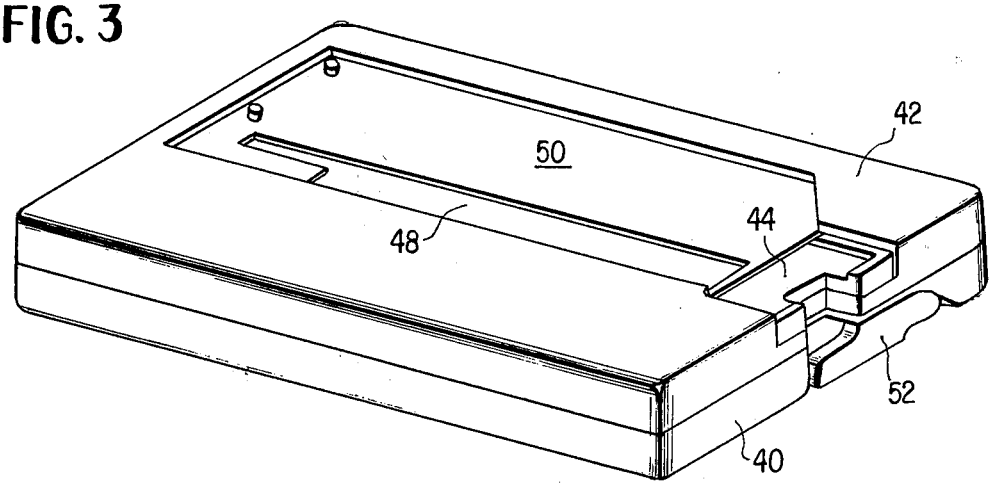
FIG. 3 is a perspective view of the transaction-log recorder of FIG. 2 when closed.

Referring to FIGS. 2 and 3, there is shown a portable transaction-log recorder or portable recorder member 39 of the same type as described in aforementioned U.S. application Ser. No. 434,209. The recorder includes a base portion 40 and a cover 42 pivotally mounted at one end thereof. A frame 40A is attached to base 40. The frame 40A incorporates a printing plate receiving tray 44, into which may be inserted a customer credit card or the like. Tray 44 is slidable and after a credit card or the like is inserted therein, it is slid to the position shown in FIG. 2 where it is latched in place subject to certain interlock conditions being met, which will be described below. Also incorporated in the frame is a counter 46 comprising a plurality of counting wheels, which can be incremented by one or more, each time they are actuated. The purpose of counter 46 is to record the number of each transaction processed by the imprinter and recorder. Frame 40A also includes means (not shown) for receiving a printing plate identifying the dealer or the like. Also included is an opening (not shown) through which variable amount assembly 22 of FIG. 1 extends when the recorder is placed on bed 20. The lid 42 has a longitudinally extending opening 48 therein. Provided on the upper surface of lid 42 is a recessed portion 50 for receiving a document to be imprinted such as an invoice, sales receipt or the like. Disposed at the side of the base is a lever 52, which advances log sheet 54 subsequent to each transaction so that the data of the next transaction will be imprinted on the next line of log sheet 54.

Figure 4:
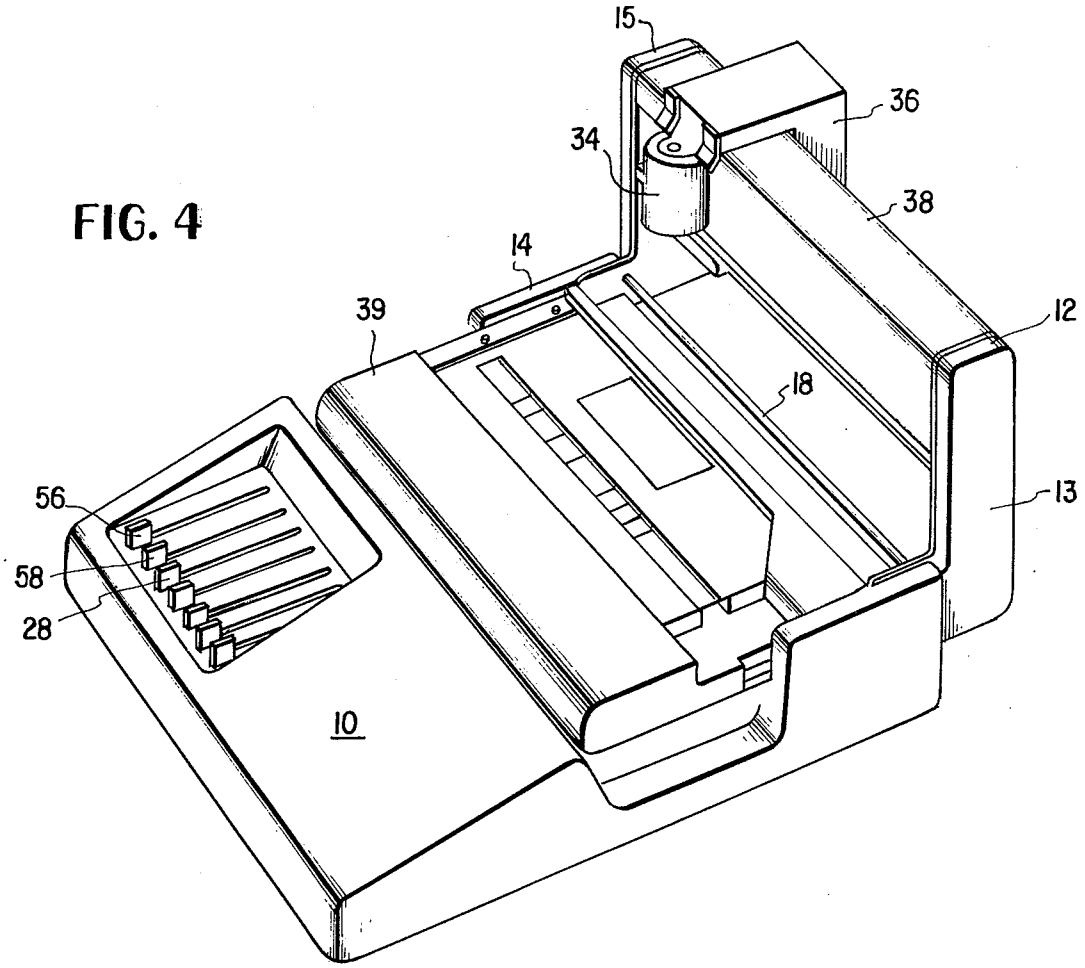
FIG. 4 is a perspective view of the imprinter of FIG. 1 with the recorder of FIG. 2 positioned therein.

As mentioned above, the latching of printing plate receiving tray 44 is subject to an interlock condition. That is, before this tray can be latched in place, lever 52 must be operated to advance log sheet 54. The actuation of lever 52 releases the interlock and permits tray 44 to be latched in place after it is slid to the position shown in FIG. 2. The details of this interlock and the operation of lever 52 to advance log sheet 54 are described in aforementioned application Ser. No. 434,209 and form no part of this invention. After the credit card has been inserted in recorder 39, the recorder is placed on bed 20 of the imprinter, as shown in FIG. 4. At this time, arms 30 and 32 of FIG. 1 are in position to respectively coact with counter 46 and the latch for the tray 44, as will be described in more detail hereinafter. After placement of the recorder on bed 20 and after the variable amount data has been set in the imprinter via keyboard 28, the head 12 may be lowered to the closed position shown in FIG. 5 assuming certain interlock conditions have been met, which will be described. The recorder may be locked into position on bed 20 by means shown in aforementioned application Ser. No. 434,209.

In operation, the user first advances log sheet 54 by actuating lever 52, in the manner described above. This removes the interlock on tray 44 so that a credit card or the like may be inserted therein and the tray closed and latched in the position shown in FIG. 2. Next, an invoice or the like is positioned at recessed portion 50. This is followed by positioning of the recorder in the imprinter as shown in FIG. 4. Arm 32 in bed 20 senses the removal of the above mentioned interlock on tray 44 and removes a secondary interlock on the head 12. Thus, head 12 cannot be lowered to the position shown in FIG. 5 unless log sheet 54 has been advanced one position to remove the interlock on tray 44.

Next, the operator sets a product/service code in variable amount assembly 22 via levers 56 and 58 of keyboard assembly 28. This code for a gasoline station might indicate what product was sold or service rendered. Thus, the setting of product code 10 by levers 56 and 58 might indicate tires were sold in the particular transaction being recorded by the imprinter. It is necessary, in accordance with one aspect of the invention, that the units digit of the code be actuated before a primary interlock on head 12 is removed. That is, lever 58 must be moved from the zero position before head 12 can be lowered to the position shown in FIG. 5. Broadly, at least one preselected item of the variable data must be set to a non-zero value to remove the primary interlock. After the product/service code is set, the amount of the transaction is set by the remaining levers of keyboard 28 in variable amount assembly 22.

Next, head 12 is lowered to the position shown in FIG. 5 until it is latched into position. As the head is lowered to its latching position, the digits set in the variable amount assembly 22 are centralized in a manner to be described hereinafter so that the planes of all variable amount digit faces are aligned with and parallel to the printing plane established by roller platen 34 during imprinting. That is, during imprinting, an imaginary printing plane tangent to the lowest point on roller platen 34 is established as roller platen passes over the print bed. If any of the variable amount digits are incompletely set so that the face of the digit is skewed with respect to the printing plane, the centralizing of those digits prior to imprinting corrects this.

The roller platen assembly is then moved to the right by the operator to effect imprinting of the information contained within the recorder and the variable amount assembly. After the roller platen 34 has imprinted the variable amount information, a mechansim within the imprinter automatically resets the variable amount data to zero or any other desired reference position by repositioning all levers of keyboard 28 to their zero positions. The resetting of the units digit of the product/service code lever 58 reinitiates the primary interlock on head 12, discussed above. When the roller platen reaches the end of its forward stroke, a latch release mechanism is actuated to automatically open the head 12 to the position shown in FIG. 4. Further, the roller platen assembly is automatically returned to the start position shown in FIG. 1.

As the head 12 returns to its open position at the end of the forward stroke of the platen, a counter actuating mechanism, to be described in more detail hereinafter, for recorder counter 46 is actuated by arm 30 (see FIG. 1) to increment the transaction number by one. Further, tray 44 is released to permit ejection of the tray to the side of the recorder and thereby facilitate removal of the credit card or the like. At the same time, the beforementioned interlock on tray 44 is actuated.

Processing of the transaction is completed by removing the recorder from the imprinter and obtaining the signature of the customer on the invoice, after which the invoice is removed from the recorder. The recorder is then returned to storage. Lever 52 is actuated to advance the log sheet 54 to the next transaction line whereby the log line information last imprinted is protected by lid 42 during storage.

2. Construction and Operation of Tray 44 and Counter 46

Referring to FIG. 6 there is shown a cross sectional view taken along line 6—6 of printing plate receiving tray 44 of FIG. 2. Tray 44 has a recess 60 for receiving a printing plate such as a credit card or the like. Tray 44 also has an inclined lower portion (typically a 3° incline) and is slidably mounted on an inclined upper surface 62 of frame 40A of the recorder. Tray 44 is normally biased forwardly to the right in FIG. 6 by spring means not shown in the present application but described in copending application Ser. No. 434,209. Upper surface 62 is provided with a slot 64 into which tray guide 66 extends. As shown in FIG. 6, a latch 68 is biased about pivot point 70 by spring 72 to latch tray 44 in the position shown, the latch point occurring at shoulder 74 of the latch. Latch 68 is provided with a button 76 which is engaged by arm 32 (see FIG. 1), the arm being shown in phantom lines in FIG. 6. As shown in FIG. 6 the card tray 44 is latched by latch 68 and arm 32 senses this position of the latch to remove the secondary interlock, mentioned hereinbefore. Thus, broadly, button 76 is an indicating means which indicates a predetermined condition which must exist in recorder 39 before further operation of the imprinter can proceed. This interlock will be discussed in further detail hereinafter. To facilitate contact between arm 32 and button 76 a recess 78 is provided in the bottom of base 40 and an opening 80 is provided in wall 81 forming the upper portion of the recess. Another button 82 is provided on latch 68 to permit manual opening of tray 44. Access to button 82 is provided through an opening 84 in wall 81. As can be appreciated from FIG. 6, upward pressure on button 82 will pivot latch 68 clockwise about pivot point 70 to release tray 44 and permit the ejection thereof.

A longitudinally and downwardly extending finger 86 is also connected to latch 68 and enables automatic release of tray 44 as will be explained below. A counter swing 88 is connected to counter 46 to effect, when actuated, incremental rotation of counter wheels about shaft 90 and thus increment the counter by one. The counter swing 88 has a round trigger arm 92 extending from one side thereof, which is positioned to contact arm 30 (see FIG. 1), which is shown in phantom line. Arm 30, as will be described in more detail hereinafter, extends through slot 24 in bed 20 and opening 93 in wall 81 and rotates counter swing 88 about shaft 90 at the end of the imprinting operation as head 12 is being raised to its open position, as discussed above. In particular, the swing 88 is rotated forwardly out of the plane of FIG. 6 against the bias of a spring 89 connected between pin 91 and point 95. As will now be described, this forward rotation of swing 88 also causes the automatic release of tray 44. Connected to the opposite side of swing 88 is a second arm 94 having an inclined upper camming surface 96. In particular, the upper surface of arm 94 is so inclined that the upper part of the incline is rearwardly disposed in FIG. 6 while the lower part is forwardly disposed. Finger 86 of latch 68 rests on camming surface 96. Thus, as swing 88 is rotated finger 86 rides up on surface 96 thereby clockwise rotating latch 68 about pivot point 70 to automatically release tray 44 and set the beforementioned interlock on tray 44 by means not shown but fully described in beforementioned application Ser. No. 434,209. Tray interlock latch 45 and pushrod 47 activated by lever 52 to unlatch the interlock are generally shown. Thus, by releasing tray 44, the credit card or the like can then readily be removed from the tray. It should be noted that after the tray has been ejected, the lower portion of guide 66 will maintain button 76 in its depressed position thereby indicating that the tray 44 is not latched. If the tray 44 is not latched up by the time the next transaction is to be processed, the lowered position of button 76 will be sensed by arm 32 to prevent lowering of head 12 from its open position. Hence, processing of the next transaction is prevented until appropriate steps are taken to latch tray 44 into its closed position. These steps have been discussed hereinbefore.

Thus, it can be seen that actuation of swing 88 by arm 30 effects three functions — that is, the incrementing of counter 46, the ejection of tray 44 and the activation of the interlock for tray 44.

3. Structure and Operation of Means For Effecting Secondary Interlock of Head 12.

Figure 7:
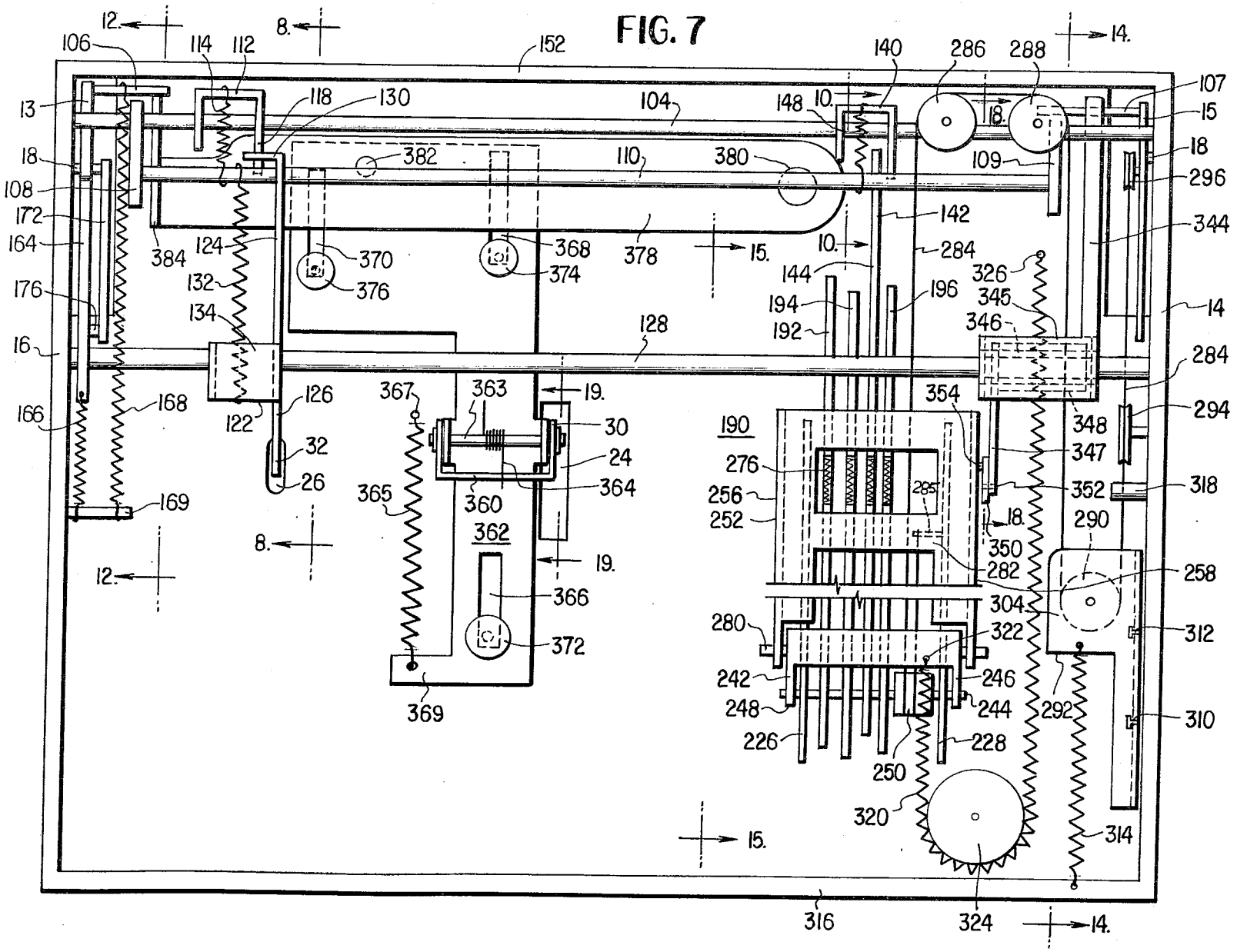
FIG. 7 is a bottom plan view of an imprinter in accordance with this invention with the head closed.
Figure 8:
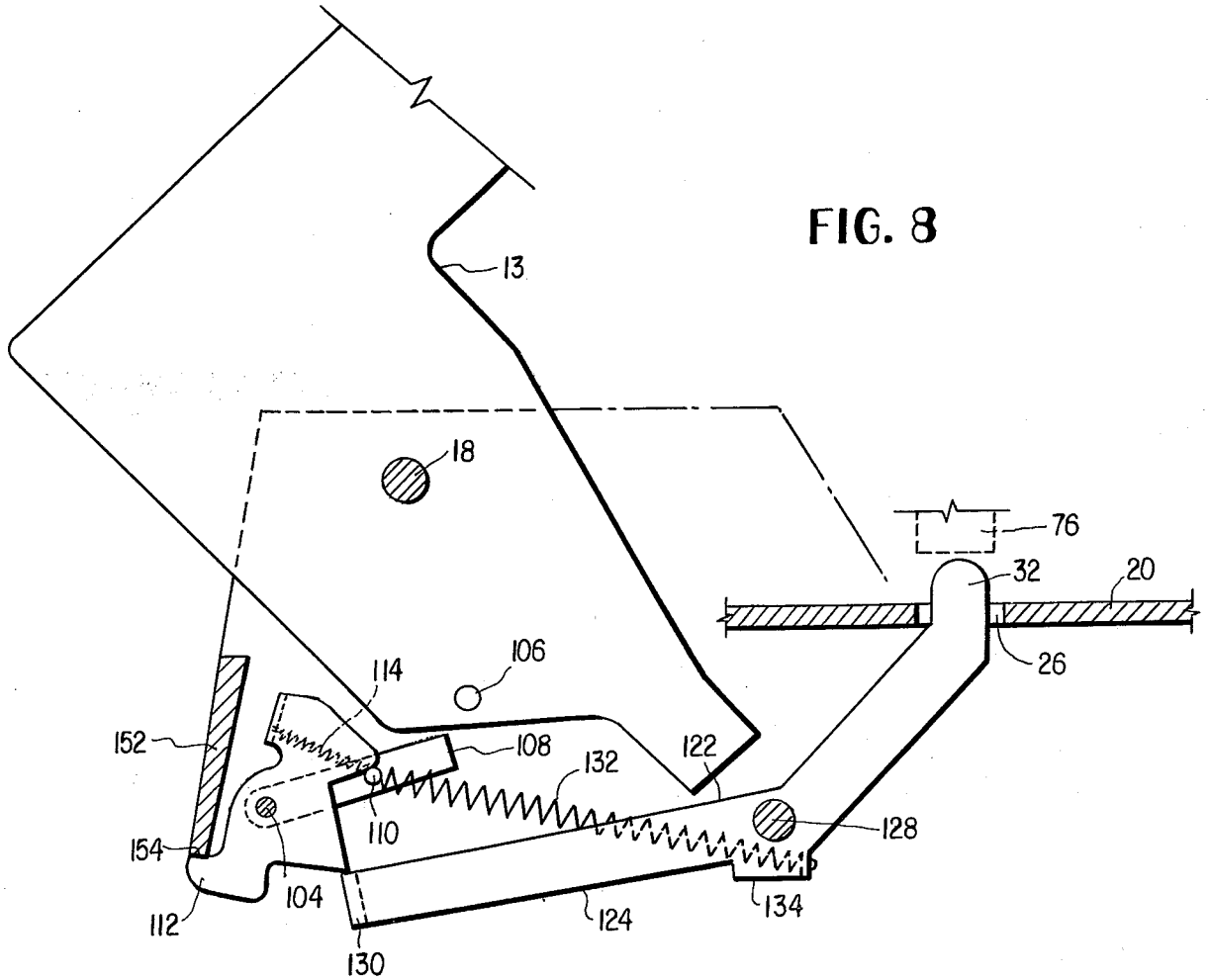
FIG. 8 is an inverted cross sectional view taken on line 8—8 of FIG. 7.
Figure 9:
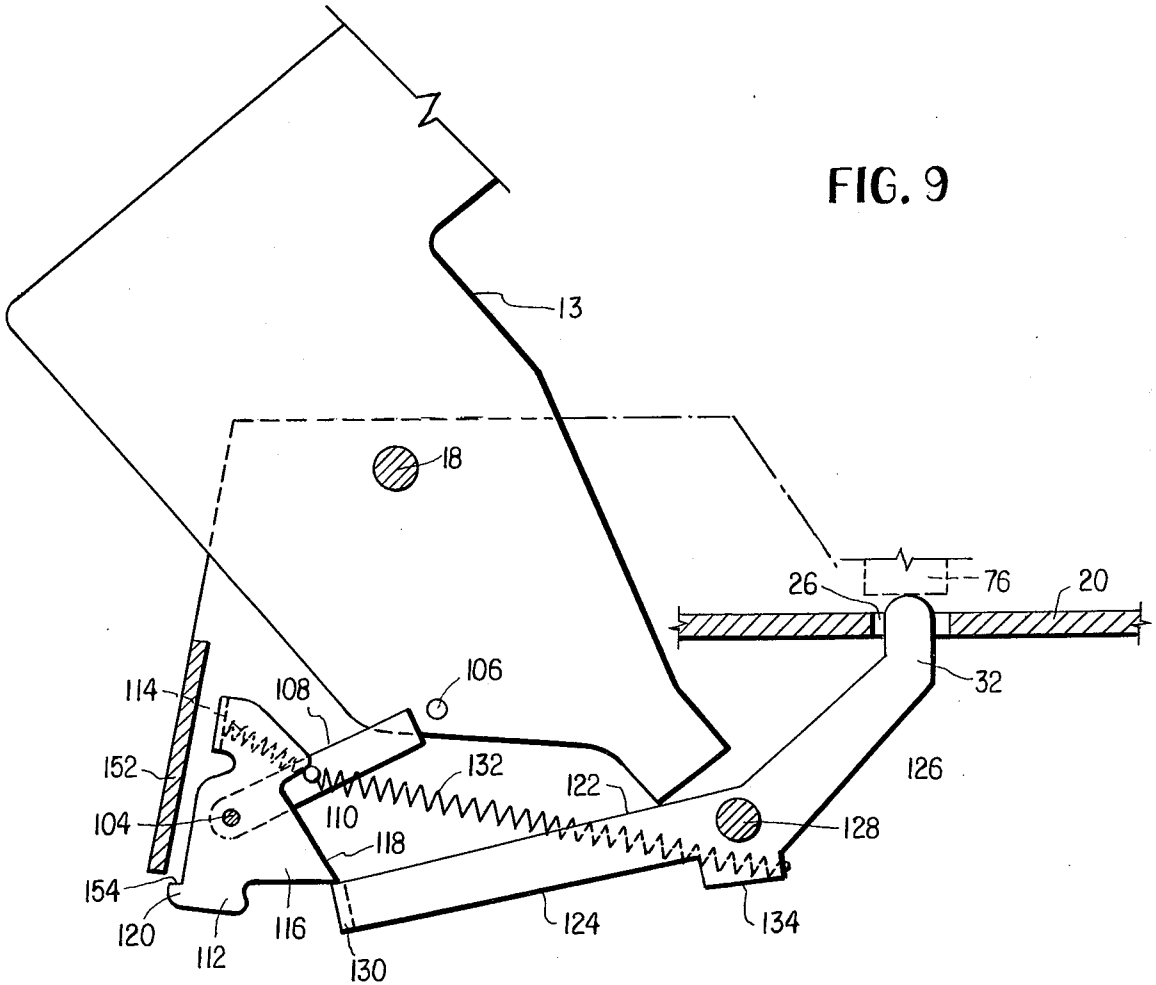
FIG. 9 is a cross sectional view illustrating the operation of the mechanism of FIG. 8.

The mechanism for locking the head in the open or raised position is shown in FIGS. 7 through 9. This includes an arm stud 106 mounted on the inner side of arm 13 of head 12. As can be seen in FIG. 9, in order to close the head, arm 13 must be rotated clockwise. However, it is prevented from doing so by a locking bar 108 disposed on a shaft 104. As can be seen in FIG. 7, shaft 104 is rotatably mounted between side plates 14 and 16 and a stud 107 corresponding to stud 106 is mounted on arm 15 while a locking bar 109 corresponding to pin 108 is also mounted on shaft 104. A second shaft 110 connects pins 108 and 109. Rotatably mounted on shaft 104 is a bracket 112. This bracket is generally U-shaped and a spring 114 connects the back of the bracket to shaft 110. A leg 116 of the bracket includes a forwardly extending portion 118 and rearwardly extending step portion 120, see FIG. 9.

The secondary interlock mechanism also includes a lever 122 comprising lever arms 124 and 126. Lever 122 is pivotally mounted on shaft 128, see FIG. 7. Lever arm 124 has a horizontally extending arm 130 disposed at the end thereof, which interfaces with forward portion 118 of bracket 112. A spring 132 is connected to lever 122 at the bottom of a U-shaped portion 134. The other end of spring 132 is connected to shaft 110. Lever arm 126 includes upwardly extending arm 32, see FIG. 1. As discussed hereinbefore, arm 32 engages button 76 of tray latch 68, see FIG. 6.

In FIG. 9 button 76 is depressed and thus lever arm 124 is upwardly urged against bracket 112 to thereby keep locking pin 108 in the position shown. Hence, as long as the tray 44 is unlatched thereby maintaining button 76 in its lower position, head 12 cannot be lowered since stud 106 cannot pass bar 108.

Upon latching of tray 44 of FIG. 6, button 76 rises to the position shown in FIG. 8 permitting the lever 122 to counterclockwise rotate to the position shown in FIG. 8. Spring 132 is of sufficient strength to keep lever arm 124 in contact with bracket 112. If no other interlocks are active, the bracket 112 will rotate to the position shown in FIG. 8 under the influence of spring 132 and gravity. Thus, as can be seen in FIG. 8, pin 108 no longer blocks clockwise rotation of arm 13 and thus, the head can be lowered.

4. Structure and Operation of Primary Interlock For Head 12.

Figure 10:
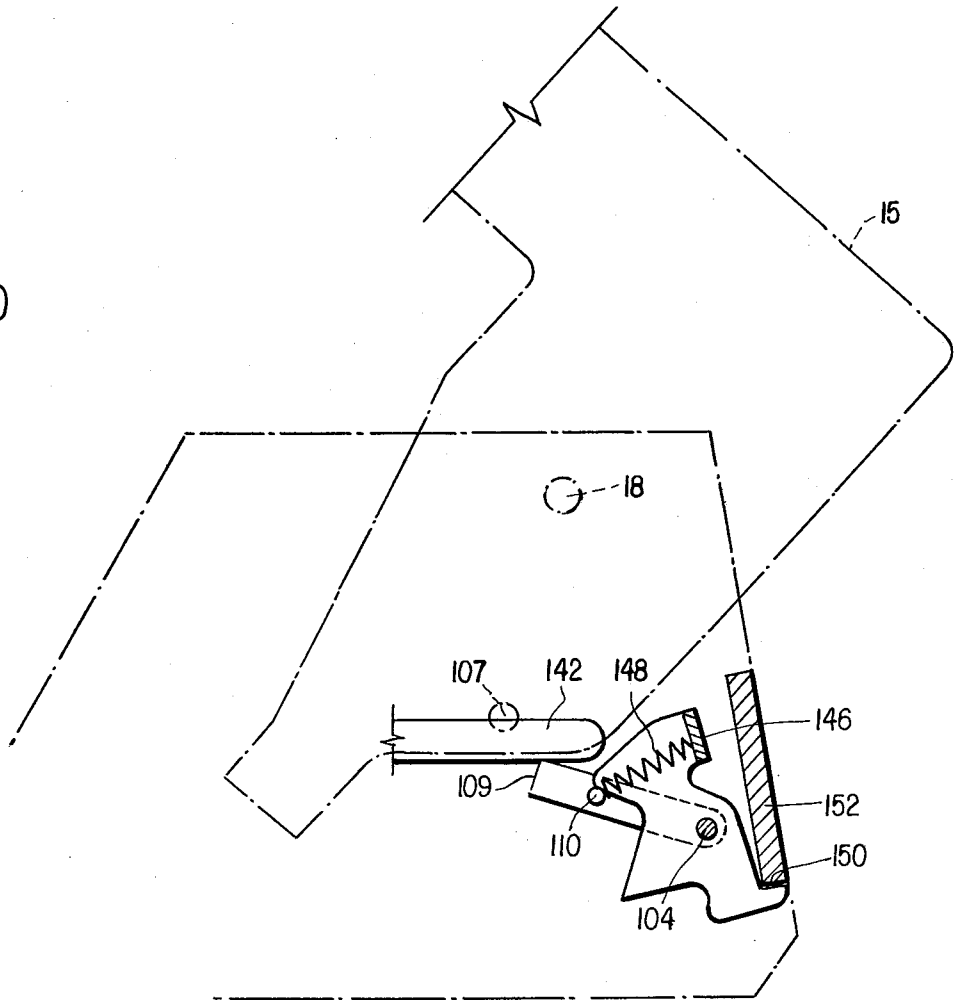
FIG. 10 is an inverted cross sectional view taken on line 10—10 of FIG. 7.
Figure 11:
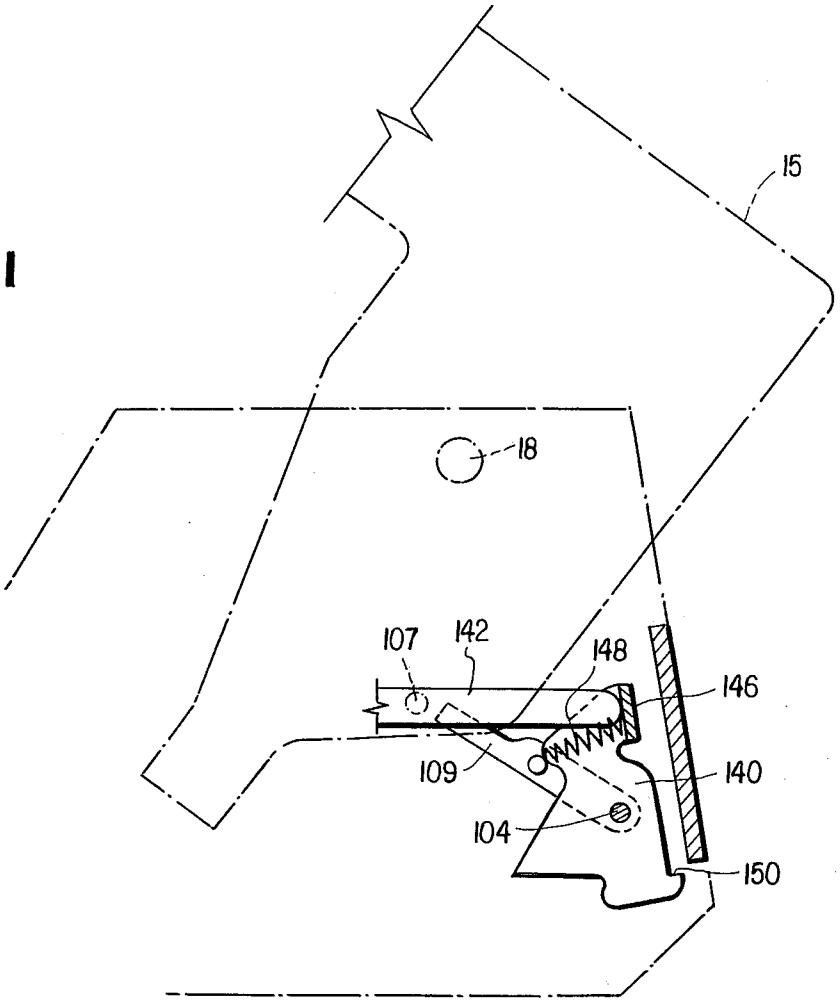
FIG. 11 is a cross sectional view illustrating the operation of the mechanism of FIG. 10.

Referring to FIGS. 7, 10 and 11, the primary interlock includes studs 106 and 107, bars 108 and 109, and shaft 104. This interlock also includes a bracket 140 mounted on shaft 104. Bracket 140 may have exactly the same configuration as bracket 112. FIG. 11 illustrates the primary interlock, when active to prevent lowering of head 12. As shown in FIG. 11, the head (and arm 15) must rotate counterclockwise in order to be lowered. However, stud 107 cannot pass bar 109 and thus the head is locked in its open position. This interlock is maintained by an extension 142 of a selector rack 144, corresponding to the units digit of the product/service code discussed hereinbefore. That is, extension 142 interfaces with the upper back portion 146 of bracket 140, as can be seen in FIG. 11, to hold the bracket in its raised position thereby also holding pin 109 in the position shown under the influence of spring 148. Upon actuation of selector rack 144, the bracket 140 is free to rotate, assuming the secondary interlock has been removed, under the influence of gravity and spring 132 (FIG. 9) to the position shown in FIG. 10. As can be seen, extension portion 142 of selector rack 144 is withdrawn from bracket 140 and thus pin 109 is lowered. Hence, head 12 can now be rotated and closed since stud 107 can bypass pin 109. A spring 148 connects portion 146 of bracket 140 to shaft 110. At the lower back extremity of bracket 140 is provided a shoulder 150 which engages the bottom of the back plate 152 of the imprinter base. Thus further rotation of bracket 140 is prevented when the head is unlocked. A similar shoulder 154 is provided on bracket 112, which also abuts the bottom of plate 152 when bars 107 and 108 are in their lowered positions.

As can be appreciated from the foregoing the primary interlock acts through bracket 140 and the secondary interlock acts through bracket 112. Since both of these brackets are mounted on shaft 104 and since both locking bars 108 and 109 are also mounted on shaft 104, both the primary and secondary interlocks must be removed before head 12 can be closed. It should be noted that the function of springs 148 (FIG. 11) and 114 (FIG. 9) is to allow rotation of bars 108 and 109 away from brackets 140 and 112 when head 12 opens. This is necessary since the automatic reset and tray open functions will have activated the interlock before the head is opened, as can be better appreciated from the following description of the invention.

5. Structure and Operation of Mechanism for Latching and Unlatching Head 12

Figure 12:
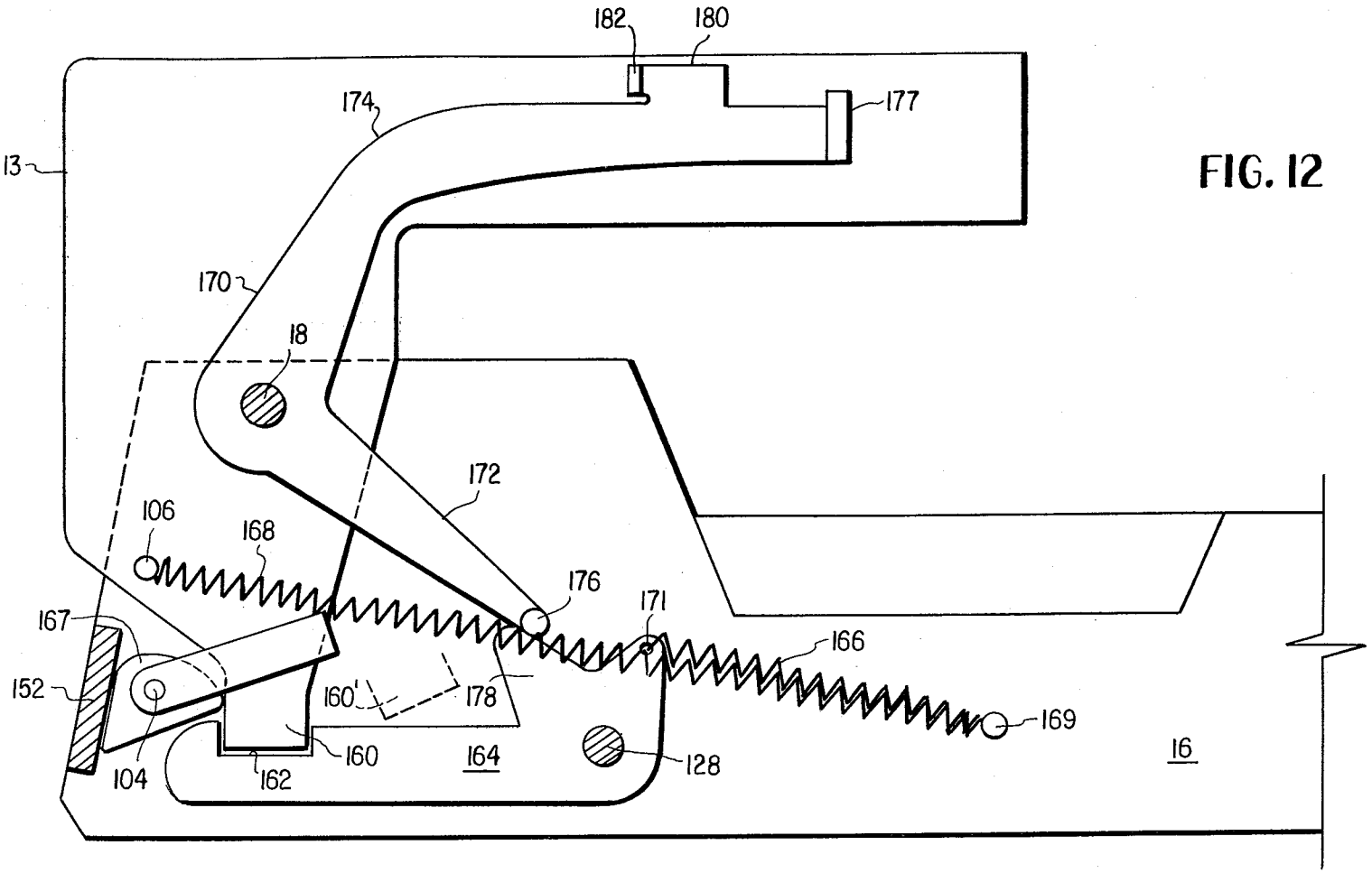
FIG. 12 is an inverted cross sectional view taken on line 12—12 of FIG. 7.

After the primary and secondary interlocks have been removed, head 12 may be manualy closed to the position shown in FIG. 12. Arm 13 includes a depending portion 160. The depending portion 160, after the head is latched, engages a notch 162 in a latch 164. Latch 164 is pivotally mounted on shaft 128, see FIG. 7. A spring 166 biases latch 164 counterclockwise in FIG. 12 around shaft 128. Spring 166 is connected between post 169 mounted on side plate 16 and projection 171 on latch 164. Depending portion 160 is shown in dotted lines just prior to the latching up of the head. As can be appreciated, as arm 13 rotates clockwise, latch 164 is pushed downwardly against the bias of spring 166 until depending portion 160 lines up with notch 162, at which time the latch springs back up to latch head 12 in its closed position. An overtravel stop is provided by a pair of locking bar spacers on shaft 104, one of which is shown at 167. Spacer 167 effects an overtravel stop for arm 13 at the point indicated at X. Spacer 167 is not shown in FIG. 7 in order that the parts adjacent thereto can be better illustrated. However, it should be appreciated that spacer 167 extends from wall 16 to bar 108 to space the bar from the wall. A corresponding spacer (not shown) is also provided for bar 109.

At the end of the imprinter stroke, the head is automatically unlatched and returned to its open position. A spring 168 is connected between arm stud 106 and post 169. Thus, as soon as latch 164 is removed from depending portion 160, the head is rotated counterclockwise about head shaft 18 to the open position. The means for unlatching head 12 includes a trigger lever 170 having arms 172 and 174. Disposed at the extremity of arm 172 is a trigger stud 176, which engages a projection 178 of latch 164. The extremity of arm 174 includes a horizontally extending projection 177 (also see FIG. 13) having an inclined camming surface 179. Inward from the extremity is disposed an arm 180 including a horizontally extending projection 182. Due to the geometry of lever 170 as shown in FIG. 12, stud 176 engages portion 178 of latch 164 while the head is closed. As stated hereinbefore, the head is unlatched and automatically opened when the roller platen assembly reaches the end of its imprinting stroke. Disposed within the roller platen assembly is a fixedly mounted, horizontally extending bar 184 having a chamfer 185 which will engage camming surface 179 at the end of the imprinting stroke, as can be appreciated in FIG. 13. This rotates lever 170 clockwise in FIG. 12 about shaft 18. Thus, stud 176 presses downwardly on portion 178 of latch 164. Hence, the latch is rotated downwardly to release head 12 and swing it up and open under the influence of spring 168. If it becomes necessary to manually unlatch the head, this can be effected by pressure on projection 182, which will also result in downward movement of stud 176 to effect the head unlatching described above.

6. Structure and Operation of Mechanism for Re-Setting Variable Amount Data to Zero and for Returning the Roller Platen Assembly To its Start Position.

Referring to FIGS. 7 and 14 – 17, there is disclosed the mechanism for automatically resetting the variable amount data to zero and for returning the roller platen assembly to its start position. In particular, referring to FIG. 7, the bottom plan view of the variable amount assembly 22 is generally indicated at 190. The variable amount assembly includes a plurality of selector racks 192 – 196 and beforementioned selector rack 144 for the units digit of the service/product code. In FIG. 7 only four selector racks, respectively corresponding to four variable amount digits, are shown for the sake of simplicity. However, it is to realized that more selector racks could be used depending on the amount of variable data desired. Further, in FIG. 7, the variable amount assembly is broken off for ease of illustration; however, normally the length of the selector racks would necessitate extending the variable amount assembly 22 forwardly to the position shown in FIG. 1.

Figure 16:
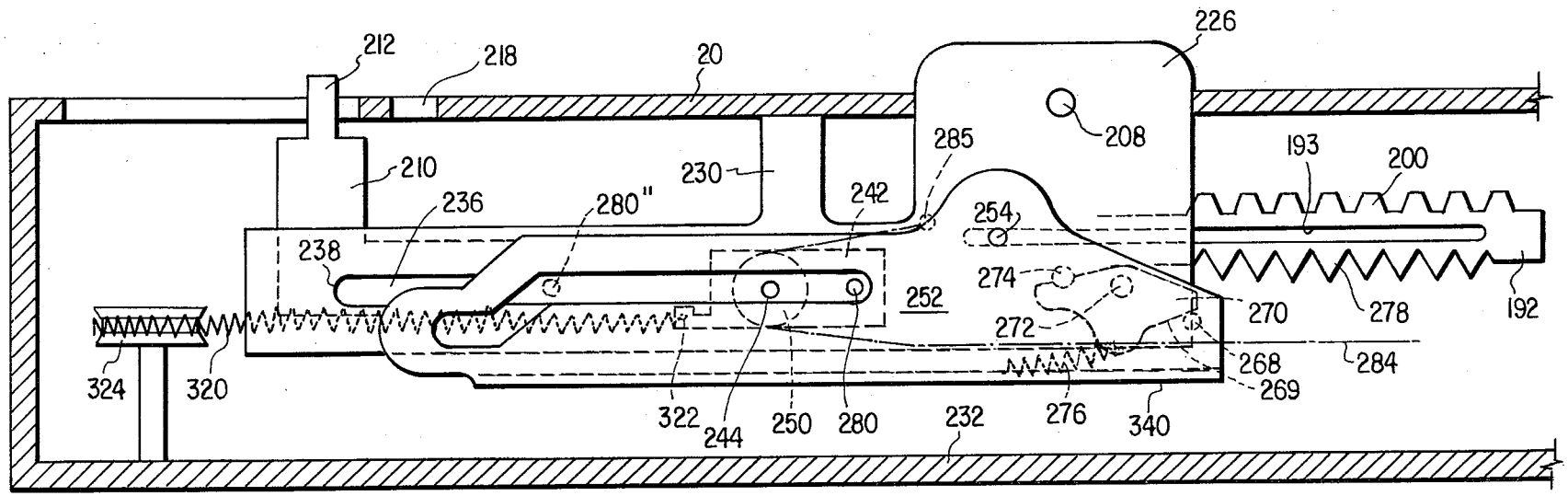
FIG. 16 is a cross sectional view illustrating the operation of the mechanism of FIG. 15.
Figure 17:
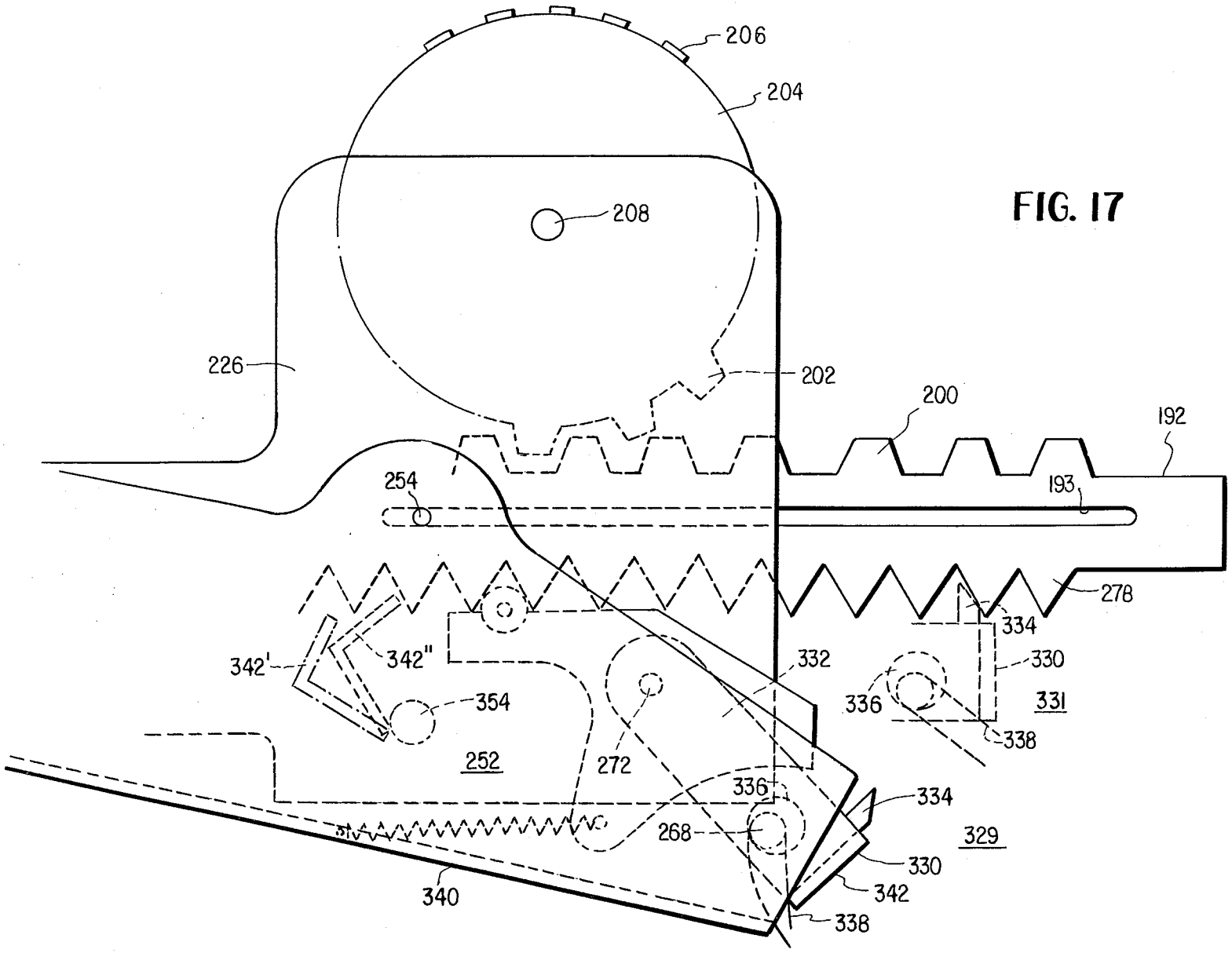
FIG. 17 is a cross sectional view illustrating certain detailed elements within the mechanism of FIG. 15 and the operation thereof.

Referring to FIG. 17 selector rack 192 is shown mounted within a variable amount assembly 190. Selector rack 192 has gear teeth 200 which engage gear teeth 202 disposed on the lower periphery of a digit wheel 204 associated with rack 192. Print element digits 206 are disposed on the upper periphery of the digit wheel, the latter being rotatably mounted on shaft 208, see FIG. 17. For ease of illustration, the digit wheels have not been shown in FIGS. 15 and 16.

Figure 15:
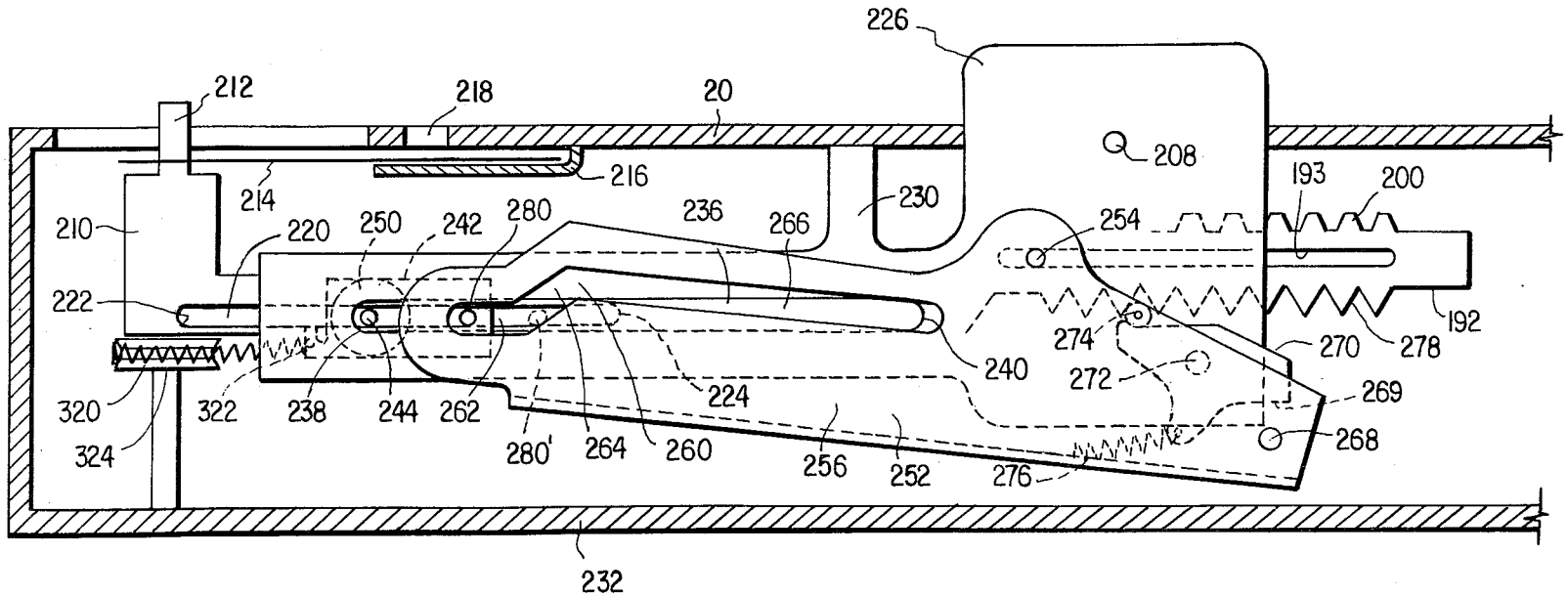
FIG. 15 is an inverted cross sectional view taken on line 15—15 of FIG. 7.

As can best be seen in FIG. 15, the forward portion of selector rack 192 has an upwardly extending portion 210. Disposed upon portion 210 is a lever 212 which extends through keyboard 28 of FIG. 1. Connected to the front of portion 210 is a slide 214 which extends into a recess 216. A window 218 permits selective viewing of slide 214. Typically disposed along the length of slide 214 are the digits zero through nine. Hence, if lever 212 were so set as to place the digit six of digit wheel 204 into the print plane of the imprinter, the digit six would also be viewed through window 218 on slide 214. Selector rack 192 is also provided with a longitudinally extending slot 220, the forward portion of which is indicated at 222 and the rearward portion of which is indicated at 224. The other selector racks are constructed similarly to rack 192 except, as mentioned before, selector rack 144 with its extension 142.

The variable amount assembly also includes a support frame having two similar side plates 226 and 228. Side plate 226 is shown in FIG. 15 as supported from bed 20 by appropriate means including member 230 for example. Support plates 226 and 228 also have longitudinally extending slots provided therein, slot 236 of plate 226 being shown in FIG. 15. The forward end of slot 236 is indicated at 238 and the rearward end thereof is indicated at 240. Mounted over side plates 226 and 228 is a U-shaped slide bracket 242 as can best be seen in FIG. 7. A pulley shaft 244 extends from the forward portion of leg 246 across to the forward portion of leg 248 of slide bracket 242. Mounted upon this shaft is a pulley 250. A reset shaft 280 is also mounted on bracket 242 as will be described in more detail below.

Also mounted over side plates 226 and 228 is a detent lever assembly 252. This assembly is general U-shaped and is pivotally mounted on side plates 226 and 228, the pivot shaft on plate 226 being indicated at 254 and extending from plate 226 to plate 228 through slots in the selector racks, one of which is indicated at 193. Detent lever 252 includes legs 256 and 258. Disposed within each leg is a slot, slot 260 of leg 256 being shown in FIG. 15. As can be seen in FIG. 15, slot 260 includes a generally longitudinally extending first portion 262, upwardly directed portion 264 and a second longer, longitudinally extending portion 266. Also mounted across the rearward portion of detent lever 252 is a detent unloading shaft 268. As will be brought out hereinafter, the purpose of detent lever 252 is to disengage or unload detenting action from the selector racks thereby facilitating the automatic return of the racks to zero. The detenting action is effected by a detent assembly 270 rotatably mounted on a shaft 272 extending between side plates 226 and 228. As is conventional, a separate detent assembly is provided for each digit wheel. The detent assembly 270 has disposed on the top thereof a detent roller 274 and in FIG. 15 is clockwise biased about shaft 272 by a spring 276. Thus, detent wheel 274 is normally urged against triangular teeth 278 provided on the bottom of selector rack 192. Hence, the detent assembly tends to hold the digit wheels 204 in a fixed position during the imprinting operation.

As can be seen in FIGS. 7 and 15, reset shaft 280 extends across the variable amount assembly. This shaft, in particular, extends through both side slots of detent lever 252 and is shown extending through slot 260 of leg 256 in FIG. 15. Further, shaft 280 extends through the slots in side plates 226 and 228. Also it extends through and is connected to openings respectively disposed in the forward portions of legs 246 and 248 of bracket 242. Finally, shaft 280 extends through all of the slots of the selector racks 144 and 192–196. As will be brought out hereinafter, this shaft is instrumental in both actuating the detent lever 252 to lower the detent assemblies and for resetting all selector racks to zero.

In order for shaft 280 to reset the selector racks to zero, a pulley system is provided which renders shaft 280 responsive to forward movement of the roller platen assembly during the imprinting stroke. The exact manner by which shaft 280 effects this function will be described hereinafter with respect to FIG. 16.

Figure 14:
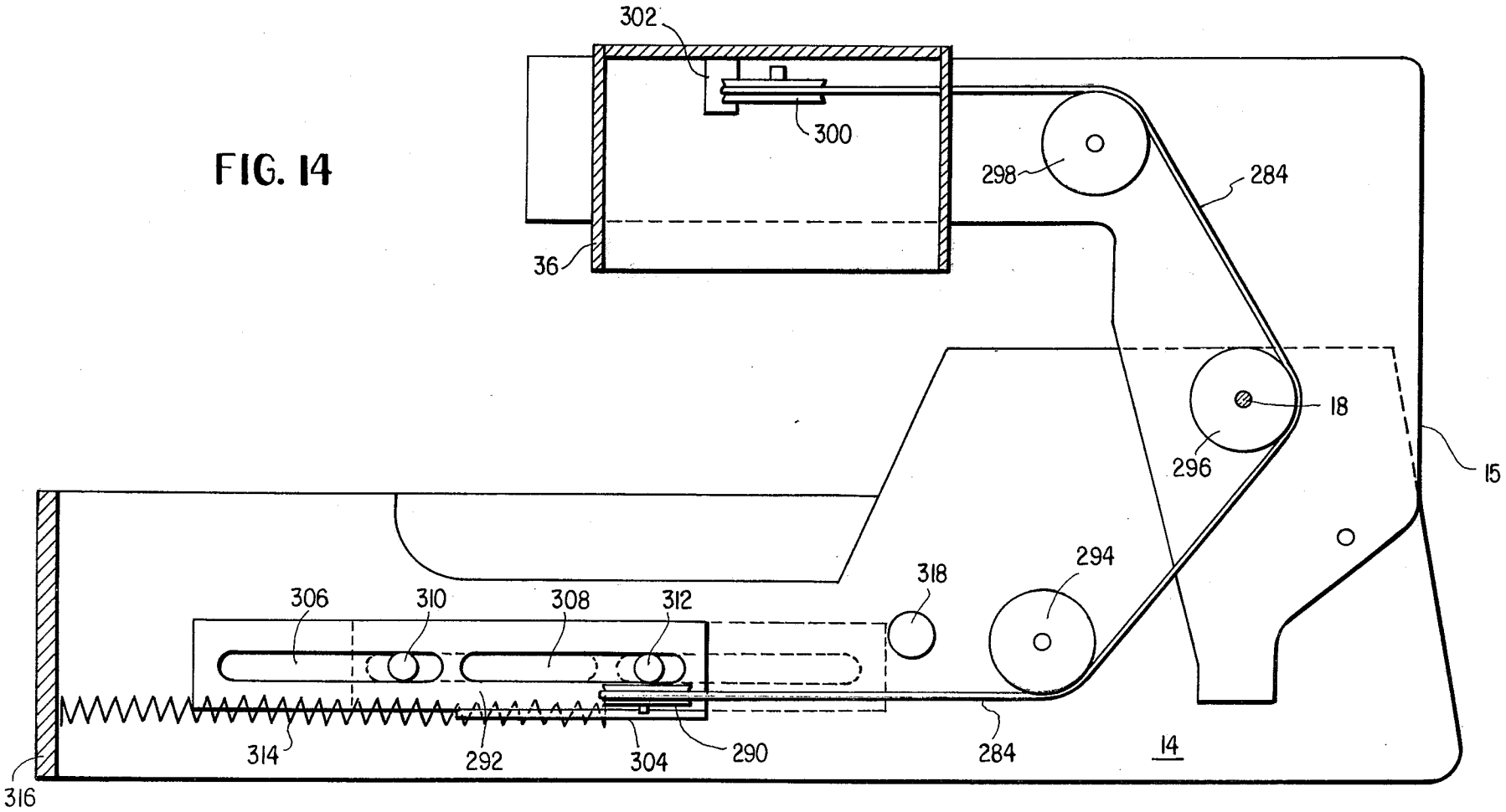
FIG. 14 is an inverted cross sectional view taken on line 14—14 of FIG. 7.

The above mentioned pulley system will now be described. The cable 284 for the pulley system is tied at one end to a stud 285 on frame 228, as can be seen in FIG. 7. The cable 284 wraps around pulley 250 and extends around pulleys 286 and 288. It then extends around pulley 290 disposed on a bias slide 292, as can also be seen in FIG. 14. The cable then proceeds around a pulley 294 mounted on side plate 14. It then extends to a pulley 296 mounted on arm shaft 18 of head 12. Referring to FIG. 14, the cable 284 then extends around a pulley 298 also mounted on arm 15. It next extends to a horizontally oriented pulley 300 also mounted on arm 15. After extending around pulley 300, it is tied to a post 302 mounted in the top of carriage 36 of the roller platen assembly.

The pulley system is spring loaded at two points so that the roller platen assembly can be moved past the variable amount data before resetting of the racks commences. In order to prevent resetting of the racks until the variable data has been imprinted, slide 292 is utilized, this best being shown in FIGS. 7 and 14. Slide 292 is a vertically disposed, longitudinally extending plate having a horizontally extending projection 304 upon which pulley 290 is mounted. Longitudinally disposed along slide 290 are a pair of slots 306 and 308. Mounted on side plate 14 are a pair of guide posts 310 and 312, upon which slide 292 slides. A first spring 314 is connected between the front plate 316 of imprinter base 10 and the forward edge portion of projection 304 of the slide. As the roller platen assembly is moved forward, the pulley 290 is pulled to the right in FIG. 14 until the slide 292 engages a stop 318 mounted on side plate 14. The position of the slide at this time is shown in dotted lines in FIG. 14. At this time the roller platen assembly has moved over the variable amount data to effect imprinting thereof and thus resetting of the variable amount data can commence.

The pulley system is also spring loaded by a second spring 320. This spring is connected to bracket 242 at 322 and wrapped around a pulley 324 and tied at its other end to a post 326 mounted on the underside of bed 20, as can be seen in FIG. 7. Since pulley 250 is mounted on bracket 242, spring 320 loads the pulley system. The force exerted by spring 320 is greater than that of spring 314 and thus as the roller platen assembly is moved forward, spring 314 will extend first to permit bias slide 292 to move to stop 318 before spring 320 is permitted to extend. Hence, movement of the roller platen assembly past the variable amount data before resetting thereof is ensured. That is, stop 318 is so positioned that it will not be engaged by slide 292 until after the roller platen assembly has passed the variable amount data. the extent extend of this initial movement by the roller platen assembly is indicated by the interval labled "Bias Slide Travel" in FIG. 13.

After further movement of pulley 290 is prevented by stop 318, pulley 250, see FIG. 15, starts to move to the right under the influence of the pulley system as the operator continues to move the roller platen assembly forward. As the pulley is pulled, bracket 242, upon which the pulley is mounted, is also moved to the right. Since reset shaft 280 is mounted on bracket 242, it also moves to the right along the slots in plates 226 and 228. In FIG. 15, shaft 280 moves along slot 236. When shaft 280 reaches the position indicated at 280' (FIG. 15), continued forward movement of the shaft will pivot detent lever 252 about its pivot shaft 254 since shaft 280 also extends through slot 260 (FIG. 15) in the lever and the corresponding slot on the opposite side of the lever.

When shaft 280 reaches the point indicated at 280'' (FIG. 16), detent lever 252 is completely pivotted and has completely removed or unloaded the detent assembly 270 from the teeth 278 on the lower side of the selector racks. This is effected by detent unloading shaft 268. As can be seen in FIG. 15, Shaft 268 is removed from edge 269 of the detent assembly. However, as the detent lever is rotated to the position shown in FIG. 16, the shaft 268 engages edge 269 to pivot the detent assembly counterclockwise about detent shaft 272 so that detent wheels 274 no longer engage teeth 278. Once the detents are unloaded, the selector racks can be reset to zero without loading interference from the detent wheels. The foregoing detent unloading action occurs at all selector racks as indicated hereinbefore.

When shaft 280 is at the point indicated at 280'' in FIG. 16, the edge 224 of internal slots 220 of any selector racks which have been set to nine will initially be contacted by the shaft. Thus, as reset shaft 280 continues to move to the right in response to continued forward movement of the roller platen assembly, the shaft will start to reset any selector racks set to nine. Continued movement of shaft 280 to the right results in the eventual engagement of all racks until they have all been reset to zero. The latter occurs when shaft 280 reaches it rightmost position, as shown in FIG. 16. At this time the roller platen assembly has reached the end of its stroke and the latch release mechanism is actuated to open the head as described hereinbefore in Section 5.

Figure 13:
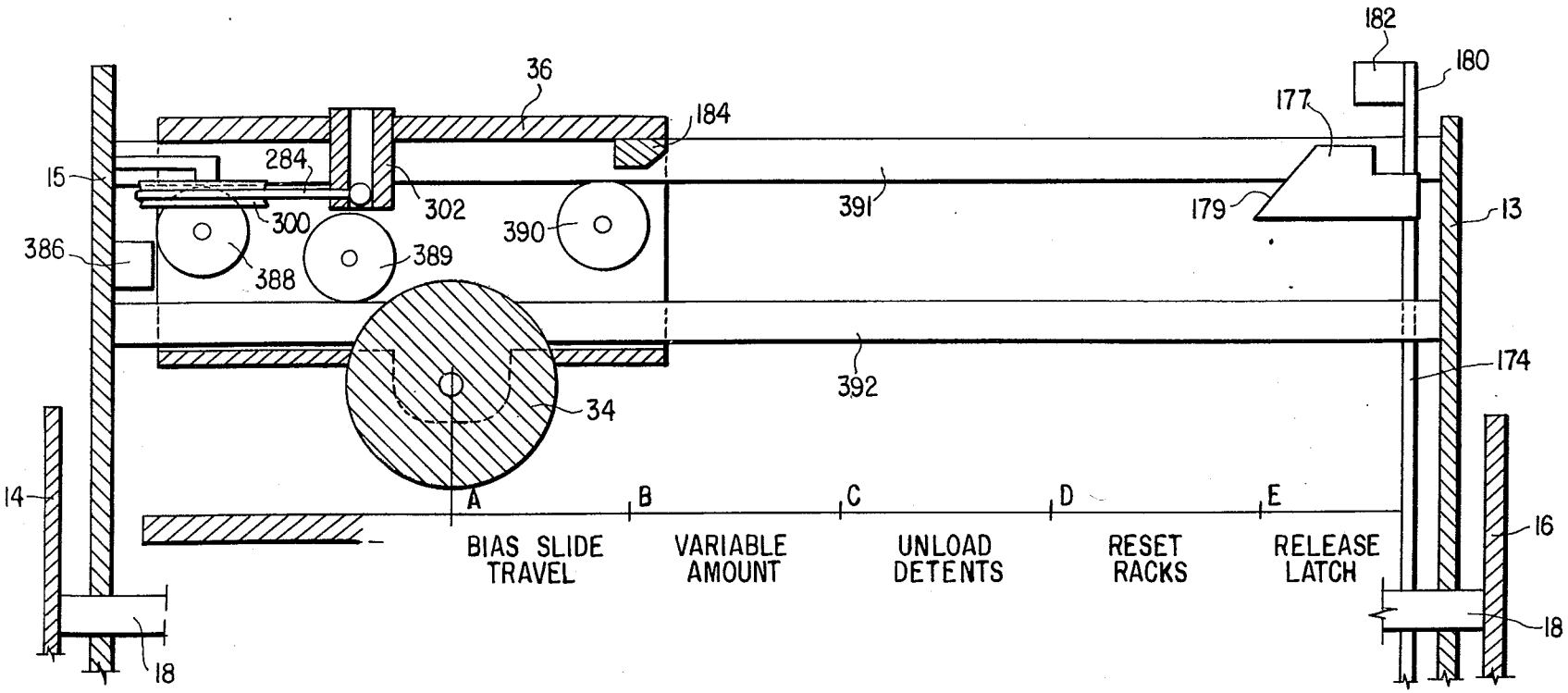
FIG. 13 is a cross sectional view of an illustrative roller platen assembly in accordance with the invention together with elements associated therewith.

In order to more fully appreciate the timing of the detent unloading together with the resetting of the racks, reference should be made to FIG. 13. The roller platen assembly is typically manually moved to the right, it being rolled along rails 391 and 392 and supported by rollers 388, 389 and 390, which are shown in phantom lines. Various arrangements are well known for transporting and supporting roller platen assemblies and as such this forms no part of the invention. Thus, at the start of its travel, roller platen 34 is at point A and moves toward point B. During this interval, spring 314 is expanded as the cable 284 is pulled along by the roller platen assembly. Thus, the basic purpose served by slide 292 and its associated spring 314 is to prevent unloading of the detents and resetting of the variable amount information until all variable amount information has been imprinted. This will occur when the roller platen 34 reaches point B. The intervals shown in FIG. 13 are not to scale but merely illustrate points along the path of travel of the roller platen assembly where certain events occur.

From point B to point C, reset shaft 280 (see FIG. 15) moves from its leftmost position to position 280', this interval being characterized in FIG. 13 as the "Variable Amount Pre-Travel". At point C unloading of the detent assembly 270 commences and when platen 34 reaches point D shaft 280 has reached position 280'' in FIG. 16 and the detents are unloaded. At point D resetting of the selector racks commences and is completed at point E, at which time shaft 280 is in its right most position shown in FIG. 16. At this time bar 184 (see FIG. 13) in the roller platen assembly engages camming surface 179 whereby the head is automatically opened, as described hereinbefore. At this time the operator will release head 12, the roller platen assembly being immediately and automatically returned to its leftmost or start position shown in FIG. 13 under the influence of cable 284 tensioned by springs 314 and 320.

7. Structure and Operation of Mechanism for Preventing Movement of Selector Racks During Return of Roller Platen Assembly to Start Position.

Referring to FIG. 17, there is disclosed means for preventing movement of the selector racks during the return of the roller platen assembly to its start position. As the roller platen assembly is being returned to its start position under the influence of spring 320, the reset shaft 280 slides along in the slots of the selector racks. At this time the detents are still unloaded from the racks and there is a tendency for the racks to be removed from the zero position to which they have just been reset by shaft 280 as it returns to its start position shown in FIGS. 7 and 15. This is prevented by an anti-backup unit 329, see FIG. 17. This unit comprises a U-shaped bracket 330 having approximately upwardly extending legs one of which is indicated at 332. The bracket extends across the inside of detent lever 252 and is pivotally mounted on detent shaft 272. Across the bottom of the bracket extends a blade 334 adapted to engage the teeth 278 of all selector racks. Disposed near the blade end of the bracket are openings in the leg portions thereof, opening 336 of leg 332 being shown in FIG. 17. The diameter of the openings are larger than the detent unloading shaft 268 which extends through the openings. Thus movement of bracket 330 about shaft 272 is permitted due to the relative size of opening 268 with respect to the diameter of shaft 268. A spring 338 is wrapped around shaft 268 and engages the edge of lower plate 340 of detent lever 252 and the lower edge of the cross-portion 342 of bracket 330 whereby the latter two surfaces are normally biased apart by the spring.

As stated above, there is a tendency for the selector racks to be removed from the zero position to which they have just been reset, by reset shaft 280 as it returns to its leftmost position shown in FIG. 15. Referring to FIG. 17, the anti backup unit is shown at 331 in its raised position, in which it would be when detent lever 252 is in the position shown in FIG. 16. As stated before, the detent assembly is unloaded at this time from the selector racks and would thus not be able to prevent movement of the selector racks 192 as reset shaft 280 returns to its leftmost position in FIG. 15. However, the anti-backup unit will prevent this movement. Thus, in FIG. 17, the returning shaft 280 tends to move selector rack 192 to the left. This in turn produces a force generally directed at shaft 272 upon which the anti-backup unit is pivotally mounted. However, such a force would necessarily create a very small moment and thus the backup unit will prevent any tendency for rack 192 to move to the left.

It should be appreciated that the anti-backup unit will be in position 331 as soon as the detents are unloaded and thus will be in position while the racks are being reset — that is, rack 192 is moved to the right during the resetting thereof while at the same time anti-backup unit 329 is in position 331. However, the unit will not inhibit resetting of the racks since the moment exerted on bracket 330 will be substantially clockwise around pivot 272 in FIG. 17. Thus, the bracket 330 together with blade 334 will be pressed downwardly against spring 338 and away from teeth 278 as the crest of each tooth passes. Since opening 336 is substantially larger than detent unloading shaft 268, the bracket 330 can be readily depressed as each tooth crest passes. After the tooth crest passes, the bracket returns upward to the bottom of the next tooth only to be depressed again as the crest of the next tooth passes. Thus, as the selector racks are being reset, anti-backup unit 329 pivots up and down about shaft 272 until all racks have been reset. Hence, it does not interfere with the resetting of the racks. It is now in position to perform the anti-backup function described above.

As reset shaft 280 is being returned to its leftmost position in FIG. 15, it will reach the position shown at 280'. At this point, the anti-backup unit will have been lowered from rack teeth 278 and detent wheels 274 will have returned to engage the rack teeth thereby continuing to maintain the racks in a fixed position.

8. Structure and Operation of Mechanism for Centralizing Digits of Variable Amount Assembly.

Figure 18:
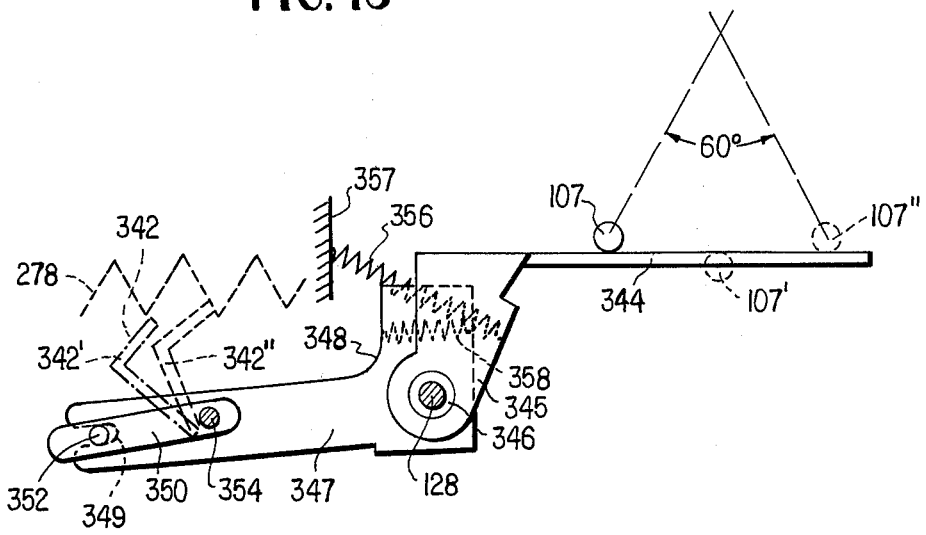
FIG. 18 is an inverted cross sectional view taken on line 18—18 of FIG. 7.

Referring to FIGS. 17 and 18, the mechanism for centralizing the digits of the variable amount assembly are shown. This mechanism includes an L-shaped blade 342 which engages teeth 278 of the selector racks. This blade is attached at one end thereof to a shaft 354 rotatably mounted between side plates 226 and 228. An enlarged opening in the leg of detent lever 252 permits shaft 354 to extend therethrough to a linkage which will be described in detail below.

The purpose of the centralizer, as discussed hereinbefore, is to align the faces of the selected digits 206 prior to the imprinting of information therefrom. That is, the faces of the digits 206 should be parallel with an imaginary printing plane established by roller platen 34. If skewed, the imprinted characters will either be unrecognizable or very distorted. If the imprinted characters are intended for machine reading, such distortion could also render the characters unreadable for such purposes. Blade 342 is in position 342', see FIG. 17, at the time head 12 is open. As the head is closed, the blade moves to position 342'' and when it is finally closed, it returns to position 342'. When it is at position 342'', rack teeth 278 are engaged and digit wheels 206 are centralized. As stated hereinbefore, the desired data is set in the variable amount assembly 22 prior to closing of the head. Thus, as soon as the head is closed, the digit wheels are centralized and ready for imprinting.

The reason for extracting the blade 342 from rack teeth 278 after head 12 has been closed but before the variable amount information is imprinted is that blade 342 would interfere with the resetting of the selector racks to zero, as has been discussed hereinbefore. Thus, blade 342 only briefly engages rack teeth 278 while head 12 is being lowered to its closed position. This brief engagement with the rack teeth is sufficient to shift the selector racks so that all digit wheels are centralized and detented by detents 270 preparatory to the imprinting operation.

The mechanism for pivoting blade 342 back and forth is shown in FIGS. 7 and 18. Arm stud 107 is mounted on arm 15 and is shown in FIGS. 7, 10 and 11. Referring to FIG. 18, stud 107 is shown in solid lines when the head is open. It rotates through an angle of approximately 60° as the head is closed, the position of the stud when the head is closed being indicated at 107''. The stud is substantially equidistant from the horizontal in both the open and closed positions of the head. However, as can be seen, the stud assumes a lower position 107' as the head is lowered to the closed position. This lowered position of the stud is utilized to effect the brief engagement of blade 342 with rack teeth 278. Thus, arm 344 extending from one leg of a U-shaped bracket 345 is continuously biased against stud 107 by a spring 356 connected to a fixed point 357 on frame 228. Bracket 345 is rotatably mounted on a sleeve 346, which in turn is rotatably journaled on shaft 128. Fixedly mounted on sleeve 346 is another U-shaped bracket 348 having an extension 347, bracket 348 being disposed inside bracket 345 and connected thereto by a heavy spring 358. Extension 347 is indented at the end thereof at 349. A pin 352 is rotatably mounted therein. A connecting arm 350 connects pin 352 and blade shaft 354.

In operation, as the head is lowered, stud 107 passes through position 107'. As it does, arm 344 is briefly rotated clockwise in FIG. 18, which in turn rotates bracket 345 connected thereto. This rotation is transmitted through spring 358 to bracket 348. Thus, arm 347 is moved upwardly together with pin 352. The upward movement of pin 352 causes shaft 354 to be briefly clockwise rotated whereby blade 342 is inserted into rack teeth 278 to effect the centralizing function described above.

As stud 107 is rotated to closed position 107', arm 344 is raised to the position shown in FIG. 18 whereby counterclockwise rotation is transmitted through the linkage in the manner described above for the clockwise rotation so that blade 342 is withdrawn from teeth 278 when the head is closed. Thus, the racks can be automatically reset after variable amount data is imprinted.

The spring connection provided between brackets 345 and 348 is provided since it is possible that as blade 342 is inserted into rack teeth 172, the blade may engage the crest of one of the rack teeth. If this were to happen and if spring 358 were not provided, the linkage could possibly break as stud 107'' reaches its lowest position 107'. This problem is avoided in the present invention in as much as spring 358 will merely give, if blade 342 has engaged a tooth crest, as stud 107 reaches position 107'.

8. Structure and Operation of Mechanism for Triggering Counter 46

Figure 19:
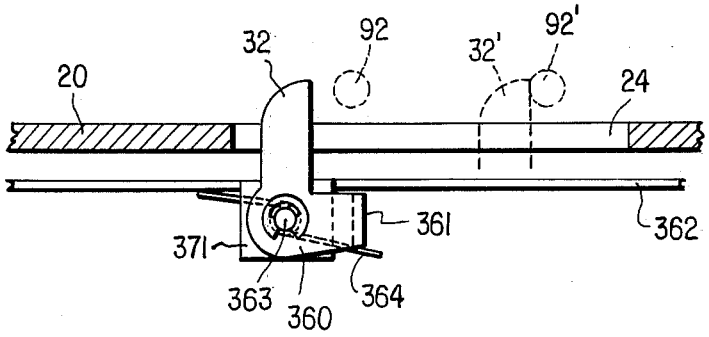
FIG. 19 is an inverted cross sectional view taken on line 19—19 of FIG. 7.

Referring to FIG. 19, trigger arm 92 of counter swing 88 (see FIG. 6) is shown in dotted lines. Live point 32 is an upward extension of a U-shaped bracket 360 pivotally mounted on shaft 363, which, in turn, is rotatably mounted on vertical extensions 371 and 373 of slides 362, which will be described in more detail hereafter with respect to FIG. 7. A spring 364 is mounted around shaft 363 and the ends thereof engage the lower portion of cross leg 361 of bracket 360 and the lower portion of slide 362 as shown in FIG. 19. The spring biases live point 32 so that cross leg 361 of bracket 360 stops against lower portion of slide 362. Thus as slide 362 moves to the right in FIG. 19 and live point 32 engages arm 92, live point 32 will swing arm 92 to actuate the counter.

Slide 362 moves to the right in FIG. 19 when the head opens after an imprinting operation. Reference should be made to FIG. 7, which illustrates the linkage for effecting this. Slide 362 has three slots 366, 368 and 370 which are respectively slidably connected to posts 372, 374 and 376, which, in turn, are mounted on the underside or recorder bed 20. An arm 369 extends from the forward end of slide 362. Connected to the arm is a spring 365, which is connected at its other end to a post 367 mounted on the underside of recorder bed 20. Spring 365 normally biases slide 362 upwardly in FIG. 7 and to the left in FIG. 19.

Slide 362 is pivotally connected to an arm 378 by a stud 382. Arm 378 is pivotally connected to a post 380 mounted on the underside of recorder bed 20. At the end of arm 380 is a downwardly extending projection 384, which engages arm stud 106, as can be seen in FIG. 7. The interface between stud 106 and projection 384 is continuously maintained by spring 365.

When the head is closed, live point 32 is as shown in FIGS. 7 and 19. At the end of the imprinting stroke, the head automatically opens as described hereinbefore and arm stud 106 moves forward in FIG. 7. As it moves forward, it pivots arm 378 about post 380. This pivoted movement is translated into linear movement of slide 352 by pivot stud 382. Since bracket 360 is mounted on slide 362, live point 32 is moved to the right in FIG. 19, as described above, to increment counter 46 by one and unlatch tray 44, as described hereinbefore in Section 2.

Live point 32 will then be at position 32' indicated in dotted lines in FIG. 19 and the head 12 will be open. When the head is closed for the next imprinting operation, live point 32, will again pass arm 92. However, this time live point 32 will merely clockwise rotate down without actuating arm 92. After it passes arm 92, it will rotate back to the position shown in solid lines in FIG. 19 under the biasing action of spring 364. Thus, as the head is closed, no interaction occurs between the imprinter and recorder counter 46. This, as stated above, only occurs when the head is opened at the end of the imprinting stroke to update the counter for the next transaction.

Thus, there has been described the structure and operation of an improved imprinter having a variable amount assembly usable with an improved portable transaction-log recorder capable of effecting the objects stated hereinbefore.

What is claimed is:

1. An imprinter comprising:

a base having a bed;

a portable recorder member removably disposed on said bed, said portable member having receiving means for holding a printing plate and indicating means for indicating whether there exists a predetermined condition within said portable recorder member;

a head member mounted on said base where said head member is pivotally mounted on said base to permit movement of said head member to a closed position over said portable recorder member and to an open position removed from said portable recorder member;

a roller platen assembly movably mounted on said head member, said roller platen assembly including a roller platen mounted therein for imprinting data from said printing plate onto a document positioned over the printing plate in response to movement of said roller platen assembly over said document;

first locking means for releasably preventing said roller platen assembly from effecting said imprinting;

first interlock means for sensing whether said predetermined condition exists for disengaging said locking means if said predetermined condition does exist so that said roller platen assembly can effect an imprinting operation;

a variable amount assembly having variable amount data means and means for setting the variable amount data means to preselected data having non-zero values and a zero value, said variable amount assembly being so positioned with respect to said head member when the head member is in its closed position that said variable amount data is imprinted on said document by said roller platen assembly during imprinting;

second interlock means for sensing whether at least one item of said variable amount data has been set to a non-zero value and for disengaging said first locking means if said one item of data has been set to a non-zero value; and said variable amount data means including:

a plurality of data wheels having print elements disposed along the periphery thereof;

a plurality of selector racks respectively associated with said data wheels for setting said data wheels by movement of the selector racks from their respective zero positions, each of said selector racks including a longitudinal slot extending along at least a part of the length thereof;

a reset shaft extending through all of said slots;

a first pulley operatively connected to said reset shaft;

a second pulley mounted on said head assembly;

a cable connected to a fixed point within said imprinter, around said first and second pulleys and then to a fixed point within said roller platen assembly;

a first spring connected between said reset shaft and a second fixed point within said imprinter; and said reset shaft being pulled by said cable to the end of the selector rack slots as said roller platen assembly is moved forward on the imprinting stroke, each selector rack being then returned to its zero position by the reset shaft when the roller platen assembly reaches the approximate end of its forward stroke, said first spring returning said reset shaft and said roller platen assembly to their respective start positions at said end of the forward stroke.

2. An imprinter as in claim 1 including a third pulley around which said cable extends;

pulley mounting means for slidably mounting said third pulley within said imprinter;

a second spring connected between said pulley mounting means and a third fixed point within said imprinter, the strength of said second spring being substantially less than that of said first spring;

a stop member mounted within said imprinter.

said third pulley moving before said first pulley as said roller platen assembly is moved forward on the imprinting stroke because of the relative strengths ofsaid first and second springs, said pulley mounting means engaging said stop member after the variable amount data has been imprinted, at which time said second spring starts to extend to enable said resetting of the selector racks.

3. An imprinter as in claim 2 where said variable amount assembly includes:

detenting means for engaging teeth on said selector racks and detenting said selector racks into position once said data wheels have been set to keep the data wheels in position as the data thereof is imprinted during the forward, imprinting stroke of said roller platen assembly, said detenting means being pivotably mounted within the variable amount assembly; and means for removing said detenting means from said selector racks prior to the resetting of the racks.

4. An imprinter as in claim 3 including:

a detent lever pivotally mounted within the imprinter, said detent lever being substantially U-shaped and one arm thereof having slots extending along the respective legs thereof, at least a portion of said slots being upwardly directed, said reset shaft extending through said detent lever slots, a detent unloading shaft mounted across the legs of the other arm of said detent lever;

a support frame having two side plates, each of said plates having longitudinal slots extending along the side thereof, said support frame being mounted within said imprinter, said reset shaft extending through said support frame slots;

said reset shaft engaging said upwardly directed portion of said detent lever slots as it moves forward in response to the forward movement of said roller platen assembly during the imprinting stroke and pivotting said detent lever about its pivot point until said detent unloading shaft engages said detenting means to remove it from said selector racks; and said upwardly directed portion of said detent lever slots being so positioned to end before said reset shaft engages the end of any of said selector racks so that the detenting means is removed from the selector racks before they are reset.

5. An imprinter as in claim 3 where said variable amount assembly includes anti-backup means for preventing any of said selector racks from being moved from the zero position as the reset shaft returns to its start position in response to said first spring.

6. An imprinter as in claim 5 where said anti-backup means includes:

a U-shaped bracket pivotably mounted at the lower leg portions of the bracket in said variable amount assembly;

a blade extending across the cross portion of the bracket;

an anti-backup spring biasing the bracket toward said selector rack teeth;

a pair of openings respectively located in said bracket legs adjacent said cross portion of the bracket, said detent unloading shaft extending through said bracket openings, the diameter of said openings being substantially larger than the diameter of said detent unloading shaft;

said blade reasably engaging said rack teeth when said detent unloading shaft removes said detent means from the rack teeth and being repetitively pushed from the path of said gear teeth against the bias of said anti-backup spring as the selector racks are returned to zero and said blade holding said selector teeth in the zero position as said reset shaft is returned to its start position.

7. An imprinter comprising:

a base having a bed;

a portable recorder member removably disposed on said bed, said portable member having receiving means for holding a printing plate and indicating means for indicating whether there exists a predetermined condition within said portable recorder member;

a head member pivotally mounted on said base to permit movement of said head member to a closed position over said portable recorder member and to an open position removed from said portable recorder member so that the portable recorder member can be placed on and removed from said bed;

a roller platen assembly movably mounted on said head member, said roller platen assembly including a roller platen mounted therein for imprinting data from said printing plate onto a document positioned over the printing plate when said head is in its closed position in response to movement of said roller platen assembly over said document from a start position;

first locking means for releaseably locking said head member in its open position;

first interlock means for sensing whether said predetermined condition exists and for disengaging said first locking means if said predetermined condition does exist so that said head member can be lowered to commence an imprinting operation;

a variable amount assembly having variable amount data means and means for setting the variable amount data means to preselected data, said variable amount assembly being so positioned with respect to said head member when it is closed that said variable amount data is imprinted on said document by said roller platen assembly during imprinting;

second interlock means for sensing whether at least one item of said variable amount data has been set to a non-zero value and for disengaging said first locking means if said one item of data has been set to a non-zero value;

said first locking means including at least one stud mounted on said head assembly; a shaft rotatably mounted within said imprinter; and a locking pin mounted on said shaft;

said first interlock means including a first interface means mounted on said shaft and means for (*a*) contacting said first interface means to rotate said locking pin to a first position whenever said predetermined condition is not indicated by said indicating means and (*b*) disengaging said first interface means to enable said locking pin to rotate to a second position whenever said predetermined condition is indicated by said indicating means;

said second interlock means including a second interface means mounted on said shaft and means for (*a*) contacting said second interface means to rotate said locking pin to said first position whenever said one data item is set to its zero value and (*b* ) disengaging said second interface means to enable said locking pin to rotate to said second position whenever said one data item is set to a non-zero value; and said head member being movable to its closed position only if both said first and second interface means are disengaged.

8. An imprinter comprising:

a base including means for receiving a printing plate;

a head member mounted on said base;

a variable amount assembly having variable amount data means and means for setting the variable amount data means to preselected data having non-zero values and a zero value;

a roller platen assembly movably mounted on said head member for imprinting data from said printing plate and said variable amount assembly onto a document positioned over said printing plate and variable amount assembly;

resetting means for automatically resetting all of said variable amount data to the zero value after it has been imprinted on said document by the roller platen assembly; and said variable amount data means including;

a plurality of data wheels having print elements disposed along the periphery thereof, said print elements indicating said non-zero values and said zero value;

a plurality of selector racks respectively associated with said data wheels for setting said data wheels, each selector rack having a zero position corresponding to the zero value of its associated data wheel, said data wheels being set by movement of the selector racks from their respective zero positions, each of said selector racks including a longitudinal slot extending along at least a part of the length thereof;

a reset shaft extending through all of said slots;

a first pulley operatively connected to said reset shaft;

a second pulley mounted on said head assembly;

a cable connected to a fixed point within said imprinter, around said first and second pulleys and then to a fixed point within said roller platen assembly;

a first spring connected between said reset shaft and a second fixed point within said imprinter; and said reset shaft being pulled by said cable to the end of the selector rack slots as said roller platen assembly is moved forward on the imprinting stroke, each selector rack being then returned to its zero position by the reset shaft when the roller platen assembly reaches the approximate end of its forward stroke, said first spring returning said reset shaft and said roller platen assembly to their respective start positions at said end of the forward stroke.

9. An imprinter as in claim 8 including:

a third pulley around which said cable extends;

pulley mounting means for slidably mounting said third pulley within said imprinter;

a second spring connected between said pulley mounting means and a third fixed point within said imprinter, the strength of said second spring being substantially less than that of said first spring;

a stop member mounted within said imprinter;

said third pulley moving before said first pulley as said roller platen assembly is moved forward on the imprinting stroke because of the relative strengths of said first and second springs, said pulley mounting means engaging said stop member after the variable amount data has been imprinted, at which time said second spring starts to extend to enable said resetting of the selector racks.

10. An imprinter as in claim 9 where said variable amount assembly includes:

detenting means for engaging teeth on said selector racks and detenting said selector racks into position once said data wheels have been set to keep the data wheels in position as the data thereof is imprinted during the forward, imprinting stroke of said roller platen assembly, said detenting means being pivotably mounted within the variable amount assembly; and means for removing said detenting means from said selector racks prior to the resetting of the racks.

11. An imprinter as in claim 10 including:

a detent lever pivotally mounted within the imprinter, said detent lever being substantially U-shaped and one arm thereof having slots extending along the respective legs thereof, at least a portion of said slots being upwardly directed, said reset shaft extending through said detent lever slots, a detent unloading shaft mounted across the legs of the other arm of said detent lever;

a support frame having two side plates, each of said plates having longitudinal slots extending along the side thereof, said support frame being mounted within said imprinter, said reset shaft extending through said support frame slots;

said reset shaft engaging said upwardly directed portion of said detent lever slots as it moves forward in response to the forward movement of said roller platen assembly during the imprinting stroke and pivotting said detent lever about its pivot point until said detent unloading shaft engages said detenting means to remove it from said selector racks; and said upwardly directed portion of said detent lever slots being so positioned to end before said reset shaft engages the end of any of said selector racks so that the detenting means is removed from the selector racks before they are reset.

12. An imprinter as in claim 10 where said variable amount assembly includes anti-backup means for preventing any of said selector racks from being moved from the zero position as the reset shaft returns to its start position in response to said first spring.

13. An imprinter as in claim 12 where said anti-backup means includes:

a U-shaped bracket pivotably mounted at the lower leg portions of the bracket in said variable amount assembly;

a blade extending across the cross portion of the bracket;

an anti-backup spring biasing the bracket toward said selector rack teeth;

a pair of openings respectively located in said bracket legs adjacent said cross portion of the bracket, said detent unloading shaft extending through said bracket openings, the diameter of said openings being substantially larger than the diameter of said detent unloading shaft;

said blade releasably engaging said rack teeth when said detent unloading shaft removes said detent means from the rack teeth and being repetitively pushed from the path of said gear teeth against the bias of said anti-backup spring as the selector racks are returned to zero and said blade holding said selector teeth in the zero position as said reset shaft is returned to its start position.

* * * * *